US009420901B2

(12) United States Patent
Sun

(10) Patent No.: US 9,420,901 B2
(45) Date of Patent: Aug. 23, 2016

(54) LOW VOLTAGE PLUG AND PLAY DISPLAY SYSTEM FOR GENERAL APPLICATION IN GONDOLA SYSTEMS

(71) Applicant: Sungal Corp., Westport, CT (US)

(72) Inventor: Yeyang Sun, Westport, CT (US)

(73) Assignee: Sungal Corp., Westport, CT (US)

( * ) Notice: Subject to any disclaimer, the term of this patent is extended or adjusted under 35 U.S.C. 154(b) by 0 days.

(21) Appl. No.: 14/680,683

(22) Filed: Apr. 7, 2015

(65) Prior Publication Data

US 2015/0289681 A1 Oct. 15, 2015

Related U.S. Application Data

(60) Provisional application No. 61/978,509, filed on Apr. 11, 2014.

(51) Int. Cl.

| | |
|---|---|
| ***A47B 85/00*** | (2006.01) |
| ***A47F 5/00*** | (2006.01) |
| ***A47F 5/10*** | (2006.01) |
| *A47F 11/10* | (2006.01) |

(52) U.S. Cl.

CPC ..... *A47F 5/0043* (2013.01); *A47F 5/103* (2013.01); *A47B 2220/0077* (2013.01); *A47F 11/10* (2013.01)

(58) Field of Classification Search

CPC ..... A47B 21/02; A47B 21/06; F16L 3/015; F16L 3/26; F16L 3/23; A47F 5/0043; A47F 5/103

USPC ..... 108/50.01, 50.02, 23; 312/223.6, 223.1; 361/622, 601, 600

See application file for complete search history.

(56) References Cited

U.S. PATENT DOCUMENTS

| | | | | |
|---|---|---|---|---|
| 4,762,072 | A * | 8/1988 | Boundy | A47B 21/06 108/50.02 |
| 4,852,500 | A * | 8/1989 | Ryburg | A47B 21/03 108/105 |
| 4,973,796 | A | 11/1990 | Dougherty et al. | |
| 5,022,720 | A | 6/1991 | Fevig et al. | |
| 5,425,648 | A | 6/1995 | Farham | |
| 5,522,324 | A * | 6/1996 | van Gelder | A47B 21/06 108/50.02 |
| 5,901,513 | A * | 5/1999 | Mollenkopf | A47B 21/06 108/182 |
| 5,994,644 | A * | 11/1999 | Rindoks | A47B 21/06 108/50.02 |
| 6,152,048 | A * | 11/2000 | Vander Park | A47B 17/003 108/50.02 |
| 6,267,064 | B1 * | 7/2001 | Ostertag | A47B 13/021 108/108 |
| 6,990,909 | B2 * | 1/2006 | Gosling | A47B 83/001 108/50.02 |

(Continued)

*Primary Examiner* — Jose V Chen

(74) *Attorney, Agent, or Firm* — Ohlandt, Greeley, Ruggiero & Perle, L.L.P.

(57) ABSTRACT

Disclosed is a low-voltage plug and play display system that separates a load support system (e.g., brackets and gondola uprights) from a conductive system. Three embodiments include: (1) an elongate vertical electrically-insulated conductive metal strip disposed on the surface of a gondola that works with a shelf connector to supply electric current to a lighting device; (2) an elongate vertical electrically-insulated conductive metal strip contained in an upright that fits inside the gondola upright that works with a shelf connector; and (3) a transmitter (TX) strip placed on the gondola surface, or remotely, to transfer power to receiver(s) to provide electric current to a lighting device. In all three embodiments, lower voltage DC current such as DC 12V converted by an adaptor is supplied to the conductive strip or transmitter TX strip. Lighting devices include LED devices. All three embodiments work for new, or for retrofitting existing, gondola systems.

19 Claims, 20 Drawing Sheets

(56) References Cited

U.S. PATENT DOCUMENTS

| | | | | |
|---|---|---|---|---|
| 7,634,967 | B1 * | 12/2009 | Albright | H02G 3/386 108/50.02 |
| 8,033,679 | B1 * | 10/2011 | Kemmler | A47B 97/00 108/23 |
| 8,186,281 | B2 * | 5/2012 | Bastian | A47B 21/06 108/50.02 |
| 8,196,526 | B2 * | 6/2012 | Rheault | A47B 13/10 108/50.01 |
| 8,677,911 | B2 * | 3/2014 | McRorie | G06F 1/1628 108/50.02 |
| 8,979,311 | B2 | 3/2015 | Kramer et al. | |
| 8,991,775 | B2 * | 3/2015 | White | F16M 11/04 108/50.02 |
| 2007/0251428 | A1 * | 11/2007 | Mead | A47B 13/02 108/50.02 |
| 2009/0260547 | A1 * | 10/2009 | Epstein | A47B 37/00 108/50.02 |
| 2009/0293773 | A1 * | 12/2009 | Miller | A47B 21/00 108/28 |
| 2011/0044030 | A1 | 2/2011 | Pichel | |
| 2011/0204009 | A1 | 8/2011 | Karan | |
| 2012/0312196 | A1 * | 12/2012 | Newkirk | H02J 7/025 108/23 |
| 2013/0199420 | A1 * | 8/2013 | Hjelm | A47B 9/00 108/20 |
| 2013/0242561 | A1 | 9/2013 | Kramer et al. | |
| 2013/0299439 | A1 | 11/2013 | Sid et al. | |
| 2014/0285720 | A1 * | 9/2014 | Epstein | H04N 5/268 348/705 |
| 2014/0331900 | A1 * | 11/2014 | Schweiter, Jr. | G06F 3/039 108/50.02 |
| 2015/0096473 | A1 * | 4/2015 | Leukel | A47B 21/06 108/50.02 |
| 2015/0223601 | A1 * | 8/2015 | Zang | A47F 5/103 108/23 |

* cited by examiner

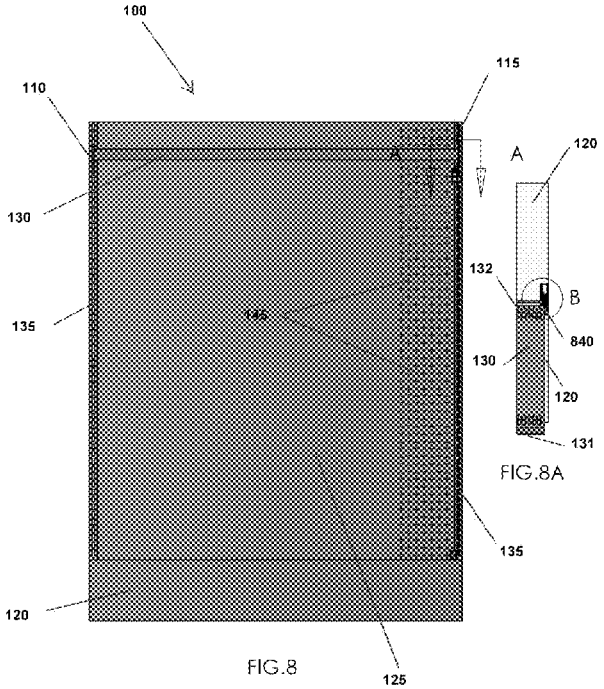
FIG.8
FIG.8A
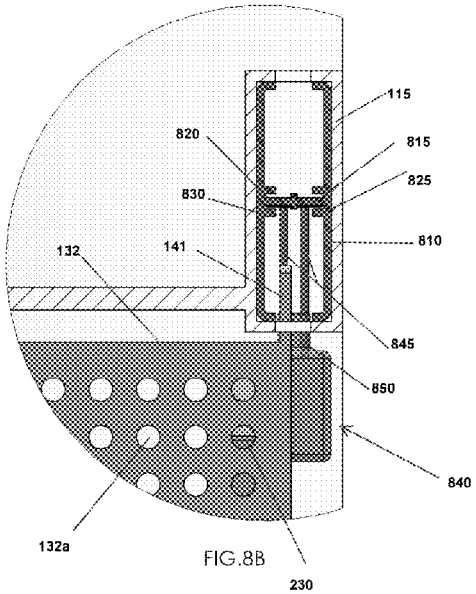
FIG.8B

LOW VOLTAGE PLUG AND PLAY DISPLAY SYSTEM FOR GENERAL APPLICATION IN GONDOLA SYSTEMS

CROSS-REFERENCED APPLICATION

This application claims priority to U.S. Provisional Patent Application Ser. No. 61/978,509, filed Apr. 11, 2014, the subject matter of which is incorporated herein in its entirety as if fully set forth verbatim herein.

BACKGROUND

1. Field of the Disclosure

The present disclosure relates generally to a display system having a lighting mechanism on the underside of a shelf for illuminating an item on display on another shelf below the lighting mechanism. The display system includes at least a removable shelf and a wall panel and may include other structures for display purposes. More particularly, the present disclosure relates to an illuminated display system that may be fitted to existing gondola systems, thereby avoiding the cost of purchasing a new gondola system. Preferably, the display system utilizes light emitting diode (LED) lighting as part of the display system.

2. Description of Related Art

Electrical wires are nearly always a problem in illuminated commercial product displays, including free-standing displays and gondola systems. Usually, an LED device, such as an LED tube and/or LED strip, is connected to a power source using wires and/or electric cords. Wires and/or cords are placed on the displays and gondola systems both horizontally and vertically, under shelves, along columns and/or other places resulting in visual chaos. This wires and/or cords also often block clear views of merchandise on the display shelves and create such potential safety issues as broken/exposed wires and/or cords that may be touched by shoppers or come into contact with electrically conductive parts of the display system or gondola, thereby creating a shock hazard.

Typical methods of lighting shelves include lighting connected to the shelves. These shelving and lighting structures generally enclose internal wiring and lighting which may be used to illuminate items on the shelves. This lighting method, however, generally prohibits the flexibility associated with modular shelving. More particularly, this lighting method requires a shelf structure that will not allow for disconnecting a shelf from a first location on a support structure and connecting the shelf at a different, second location on the support structure. In addition, these shelving systems are based on relatively high voltage AC power sources which introduce excess wiring that results in somewhat complex wiring on the shelves themselves and/or requires the use of "step-down" transformers or ballasts to cut down the voltage between the electric source and the lights. In addition, the electrical connections of these types of shelving systems are not completely insulated from the shelving components themselves, and offer potential for electrical shock to shoppers. In these shelving systems, the standards into which the shelves are hooked for support also provide the electric current for powering the lights associated with the shelves. Thus, the standards must be made of metal for the purpose of conducting the electricity and completing the electric circuit.

One solution that has been developed in an attempt to overcome the disadvantages and potential problems of the above systems is a so-called "plug-and-play" technology for use in low-voltage LED display systems. Plug-and-play technology has been mostly employed in display for cosmetic products. These types of products are not particularly heavy and do not require shelving that is as sturdy as some other products. These displays usually have walls with 12" molded plastic or similarly-sized back panels and trays. The back panels comprise vertical conductive standards connected to a power source. The molded trays comprise LEDs and conductive brackets. Low-voltage electric current passes through the vertical conductive standards of the back panels and to the tray brackets to ultimately power the LEDs. Conductive standards and brackets must both be insulated. This design employs such a support system of standards and tray brackets as part of an electrically conductive system. A fundamental problem with the above type of design is that this design is generally restricted to sizes such as 12" trays or trays of similar width. It is difficult to apply this design to larger-sized shelves, such as 36" or 48" widths as well as to 14" to 36" depths.

A second problem with the typical designs described above is that they cannot work for existing gondolas, which are not insulated. Safety criteria will not permit the use of non-insulated DC12V or DC24V low-voltage gondola uprights and shelf brackets.

As a solution to the foregoing problems, a vertical conductive clip-belt has been developed that is disposed behind the gondola wall (instead of conductive standards behind the wall) and conductive poles are placed in the display trays to make electrical connection with the vertical conductive clip belt disposed behind the gondola wall. The conductive poles are parallel to, but separate from, the support brackets that support the weight of merchandise on the display shelves. This is distinguished from previous designs that used support brackets that are also conductive. The conductive poles provide electric current to the LED devices associated with the shelves via electric circuitry that is completely insulted with no possibility of contacting any of the shelf display or gondola components and/or of contact by shoppers. This design is the subject matter of U.S. patent application Ser. No. 13/959,149 (and U.S. Provisional Application Ser. No. 61/680,987, both of which are incorporated herein by reference) of Yeyang Sun, the applicant of the present disclosure. In the '149 application, all conductive components are insulated and the support system (wall standards and tray brackets) are separated from the conductive components of the system (wall clip-belt and conductive poles). This separation development also is applicable to most size shelving, such as 12" to 48" widths and 12" to 36" depths. A benefit of the separation development is that from a visual aesthetics point of view, no wires and/or cords are exposed. Although the foregoing development may be retrofitted to existing gondola systems, the retrofitting requires dismantling of the gondola system, installing the clip belts and related wiring of the lighting system, and reassembly of the gondola system. For existing gondola systems, this can be time consuming and expensive from a labor point of view, including the cost of removing and replacing merchandise on the existing shelves.

Accordingly, there is a need for a system that provides completely insulated electrical circuitry from the power source to the lighting fixtures and back, but without the need of disassembly and reassembly of the gondola system. Preferably, such a system would also be simple to install, provide flexibility in the gondola system to which it can be applied and to shelf location, while eliminating or limiting the number of wires and/or cords that are exposed.

These and other needs are met by one embodiment of the low profile, low-voltage plug and play display system of the present disclosure. The above-described concept of separation of conductive elements from the support system is carried forward and applied in the present disclosure of a low profile, low-voltage plug and play gondola devices for general application, including to new gondola walls, as well as existing pegboards. For retrofitting existing gondola systems all that is required by the development of the present disclosure is a narrow gap, in general on the order of about ¼", between the rear edge of the shelf and the existing gondola wall, pegboard or non-pegboard. There is no need to modify the bracketing elements of the shelves of the display system to allow for an extra "gap" or space between the rear edge of the shelf and the gondola, as is necessary for some state of the art systems. As alternatives, two embodiments of the present disclosure provide for an essentially "no profile", low voltage plug and play device designed to provide low voltage for under-the shelf lighting with "no-gap" or "almost-no-gap" needed between the rear edge of a shelf and the existing gondola wall, pegboard or non-pegboard.

SUMMARY

In one embodiment in accordance with the present disclosure, there is provided a display system comprising: (1) a gondola having at least two opposed uprights providing at least two rows of vertically disposed slots for accepting shelf brackets, the at least two rows of vertically disposed slots spaced apart from each other; (2) at least one shelf having a top side, a bottom side having disposed thereon a lighting device, a front edge, a rear edge disposed adjacent to the gondola and spaced apart from the gondola by a narrow gap of about one-quarter inch (¼") or less when the shelf brackets are engaged in the vertically disposed slots, and a length with two ends, each end having disposed thereon a bracket configured to engage one of the two rows of vertically disposed slots; and (3) a power supply for the display system comprising: an elongate strip disposed substantially parallel to one row of the slots and having a thickness such that it fits in the gap between the rear edge and the gondola without modifying the shelf brackets to provide a larger gap, the elongate strip having a front side disposed distal the gondola and a rear side disposed proximal the gondola and two substantially parallel and insulated channels, each parallel and insulated channel having an elongate conductive strip disposed therein proximal the rear side, one elongate conductive strip comprising a positive pole and one conductive strip comprising a negative pole; and a shelf connector affixed to the bottom of the shelf and disposed proximal the rear edge between the elongate strip and the lighting device, the shelf connector having at least two spring actuated conductive prongs, one of the at least two conductive prongs disposed and configured to engage the conductive strip comprising the positive pole and one of the at least two conductive prongs disposed and configured to engage the conductive strip comprising the negative pole, the shelf connector further having an electric cord disposed and configured to supply and receive electric current to the lighting device, and the shelf connector oriented such that the shelf connector engages the conductive strips when the shelf engages the brackets and disengages the conductive strips when the shelf disengages the brackets. A preferred example of this embodiment will be discussed in conjunction with FIGS. 1-7.

In an alternative embodiment according to the present disclosure, the power supply and the shelf connector may be modified to provide a "no-gap" or "almost-no-gap" system wherein there is substantially no space between the rear edge of the shelf and the existing gondola wall, pegboard or non-pegboard. In this embodiment, the power supply is modified such that an insulated inner upright is provided that fits within the gondola upright, and the conductive strips may be placed on one or both sides of the inner upright. The inner upright is designed such that the conductive strips are positioned so that the shelf brackets (even if made of conductive material) are unable to contact the conductive strips. In this embodiment, the shelf connector is modified in its design such that the at least two spring loaded conductive prongs do not contact the shelf brackets (even if made of conductive material), yet fully contact the conductive strips located in the inner upright. A preferred example of this embodiment will be discussed in conjunction with FIGS. 8-14.

In another embodiment according to the present disclosure, the power supply and the shelf connector may be modified such that a wireless power transfer system is provided for powering the lighting on shelf and/or gondola surface. In this embodiment, inductive coupling between a transmitter and receiver comprises the power transfer system. The transmitter provides the power for transfer, while the receiver controls power provided to the output load. This wireless power transfer system allows for power to be transmitted to the load, e.g., an LED strip by providing transmitters along a conductive strip adhered/attached to a gondola surface. The conductive strip can be adhered to the front or the back of the gondola surface to provide a "small gap" and no "gap" system, respectively. In another example of this embodiment, the transmitter can be located remotely from the receiver at a distance, and/or the receiver can be closely associated with, such as away from the gondola surface or adjacent, e.g., wired directly to, the load, so as to eliminate the need for intervening and associated wiring, or incorporated as a component part of, the load, e.g. an LED strip, to accomplish the same result. This latter embodiment provides for a less cumbersome and sleeker appearance and simplified engineering and construction. An example of this embodiment will be discussed in conjunction with FIGS. 15-18.

These and other aspects of the present disclosure will become known to those of skill in the art form the detailed description which follows.

BRIEF DESCRIPTION OF THE DRAWINGS

FIG. 8 is a front view of gondola showing a first alternative embodiment of the present disclosure; FIG. 8A is a cross-sectional view through line "A"-"A" of FIG. 8; and FIG. 8B is an enlarged view of section "B" of FIG. 8A;

DETAILED DESCRIPTION OF THE INVENTION

Referring to the FIGS. 1-7, there is shown an overall view of a preferred example of one embodiment of the low voltage plug and play display system of the present disclosure. In the description that follows, like elements will be denoted by like reference numbers.

Figures 1, 1A, 1B:
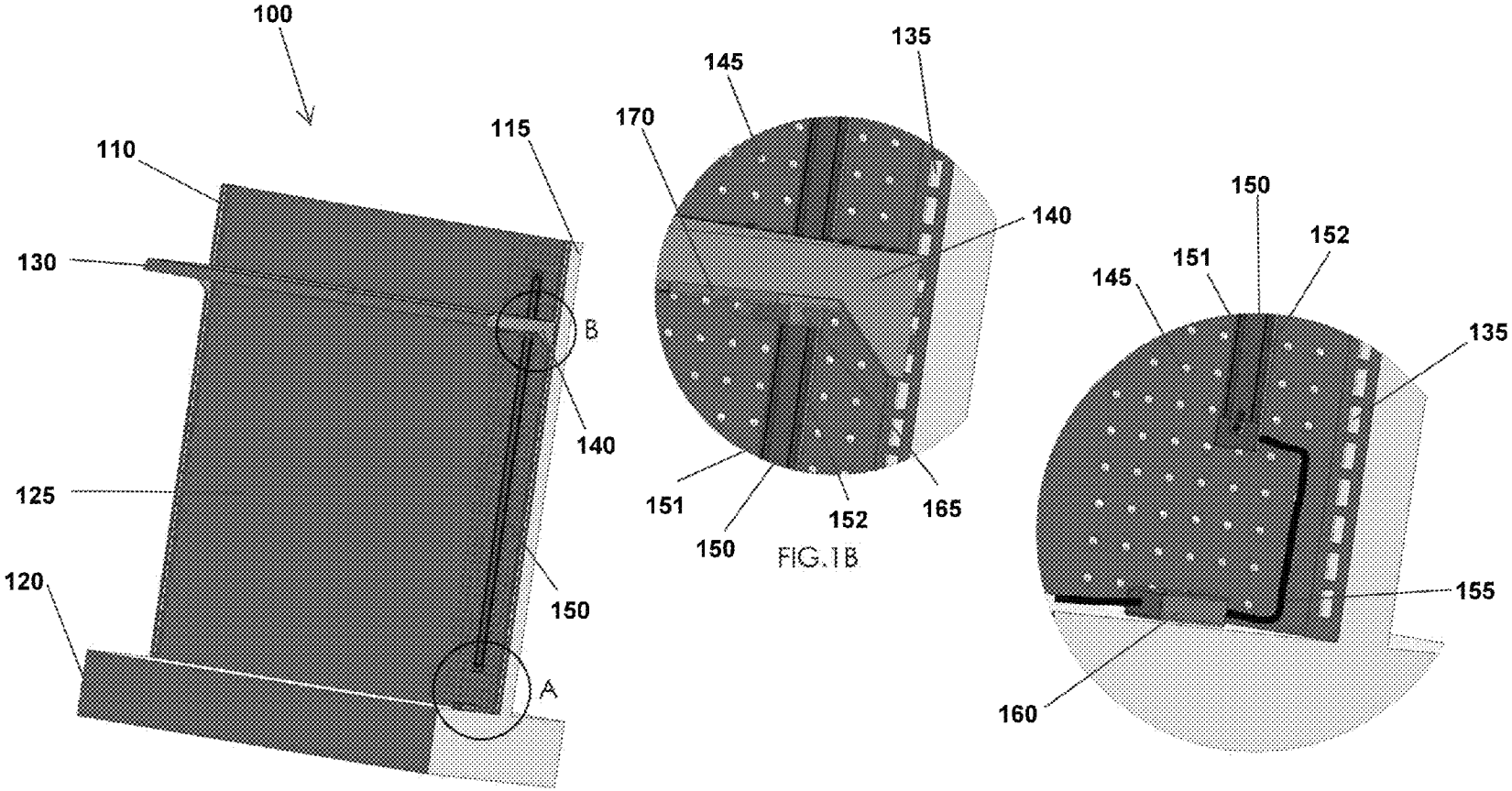
FIG. 1 is a front right side perspective view of a gondola and shelf having applied thereto a low profile C-channel strip of the present disclosure.
FIG. 1A is an enlarged view of section "A" of FIG. 1.
FIG. 1B is an enlarged view of section "B" of FIG. 1.

FIG. 1 shows a typical gondola system 100 comprised of one left gondola upright 110, one right gondola upright 115, one deck 120, one pegboard/pegboard support system 125, and at least one shelf 130. Each gondola upright 110, 115 includes a set of evenly spaced support slots 135 for accepting shelf support brackets 140, as is standard in the art. Pegboard/pegboard support system 125 includes substantially evenly spaced horizontal rows and vertical columns of pegboard holes 145. Also shown in FIG. 1 is a C-channel strip 150, which affixes vertically to pegboard holes 145 by locking pins 410 (see, e.g., FIG. 4A). FIG. 1A shows the electrical connections made by a wire/cord 155 between C-channel strip 150 and a power adapter 160. Power adapter 160 converts AC 110V-220V or other AC voltage (from a source not shown) to low-voltage DC 12V or DC 24V or other DC current. The low-voltage DC 12V or DC 24V or other DC current is conducted through left and right C-channels 151 and 152, respectively, of C-channel strip 150 to a B-plug 165 and, via wire tube 170, to LED strip (not shown in FIGS. 1, 1A and 1B), as will be described in conjunction with other FIGS. Power adapter 160 is usually placed beneath deck 120 so as to be not visible. As a result of the wiring from power adapter 160 through to B-plug 165 and then to LED strip (not shown), a complete conductive electric circuit is created.

Figure 2A:
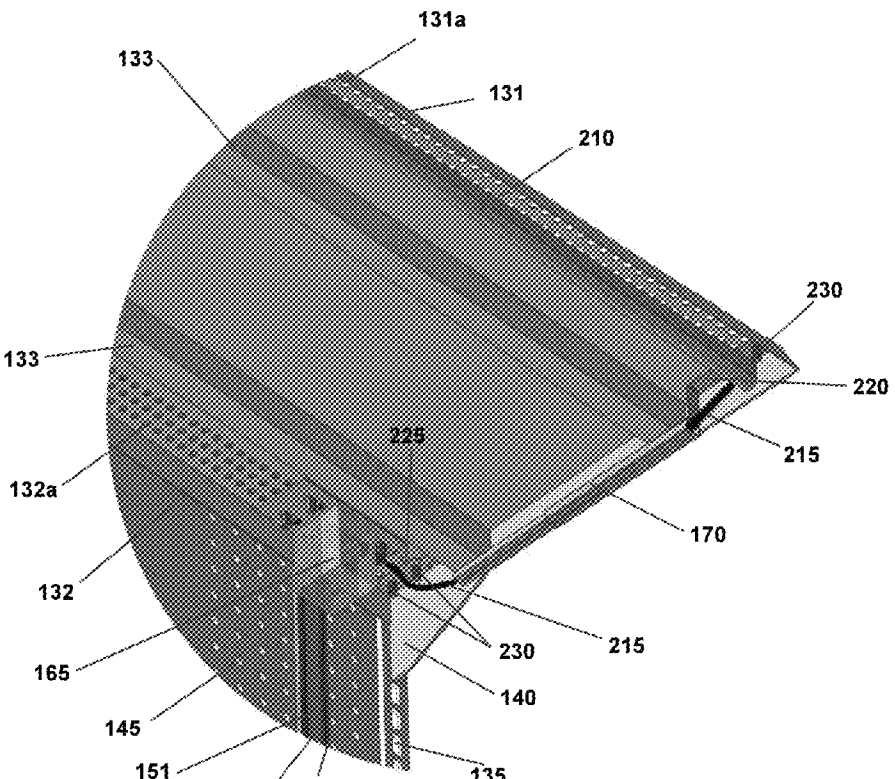
FIG. 2A is an enlarged view of section "A" of FIG. 2.
Figure 2:
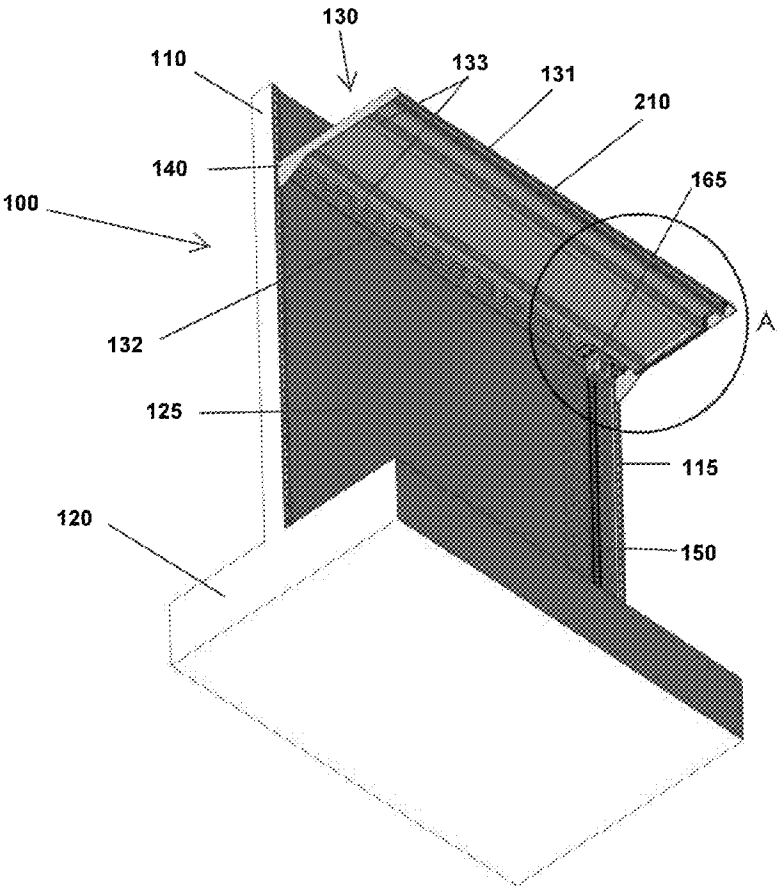
FIG. 2 is a bottom view of the gondola and shelf of FIG. 1 showing the electrical connection of an LED strip by a C-channel strip, a B-plug and a wire tube of the present disclosure.

FIG. 2 is a bottom view of the gondola and shelf of FIG. 1 showing the connection of C-channel strip 150 to shelf 130. FIG. 2A is an enlarged view of section "A" of FIG. 2. Shelf 130 has a front edge 131 and a rear edge 132. The underside of shelf 130 also generally includes one or more support bars 133 for supporting weight disposed on the top side of shelf 130. Disposed proximal front edge 131 and rear edge 132 are rows of evenly spaced (along X and Y axes) holes 131*a* and 132*a*, respectively. Disposed at each end of shelf 130 is shelf bracket 140. FIG. 2A shows an LED device 210 (such as an LED strip or LED tube) disposed on the bottom side of shelf 130. Placement of LED device 210 on the bottom side of shelf 130 serves to illuminate display merchandise (not shown) on the top side of a lower shelf (not shown). An electrical cord 215 consists of two electrical wires, one for making contact with the "positive" C-channel (151 or 152) of C-channel strip 150 and the other for making contact with the "negative" C-channel (151 or 152) of C-channel strip 150, passing through wire tube 170, as will be described in more detail in conjunction with FIG. 5. As noted, one wire of electrical cord 215 is connected to the positive pole of LED device 210 and the other wire of electrical cord 215 is connected to the negative pole of LED device 210. Wire tube 170 has a front foot 220 and a rear foot 225. Front foot 220 is connected to one or more front holes 131*a* and rear foot 225 is connected to one or more rear holes 132*a*, respectively, using push pins 230. Electrical cord 215 passes through wire tube 170 from B-plug 165 to LED device 210. LED device 210 is affixed to the underside of shelf 130 between front foot 220 (on the right side of shelf 130, as shown) and a matching metal panel similar to front foot 220 on the left side of shelf 130 (not shown) by magnets (not shown) disposed at each end of LED device 210.

Figure 3A:
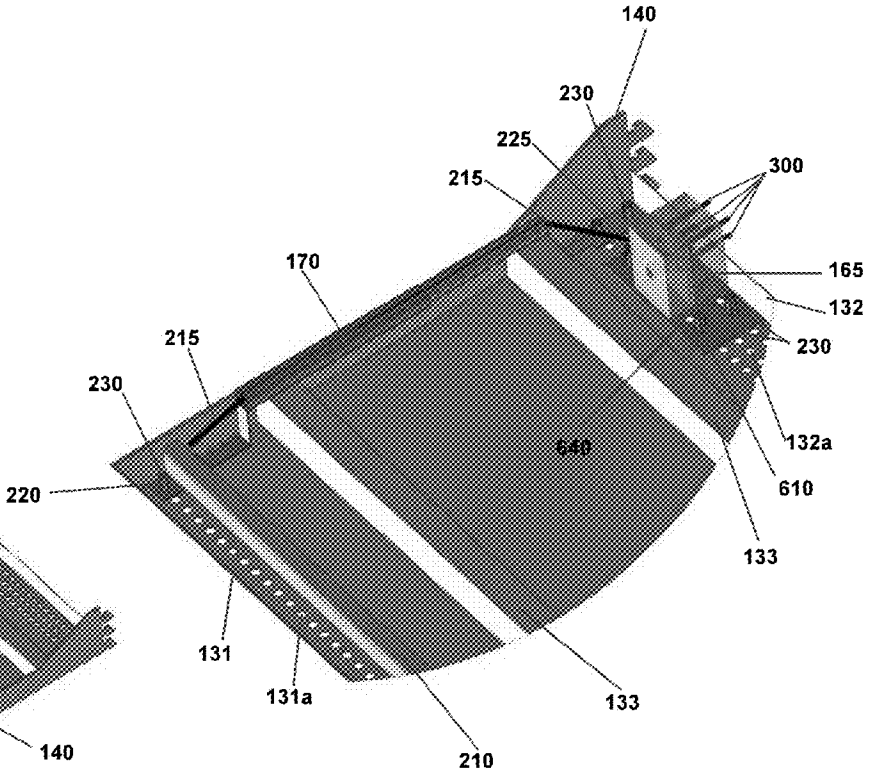
FIG. 3A is an enlarged view of section "A" of FIG. 3.
Figure 3:
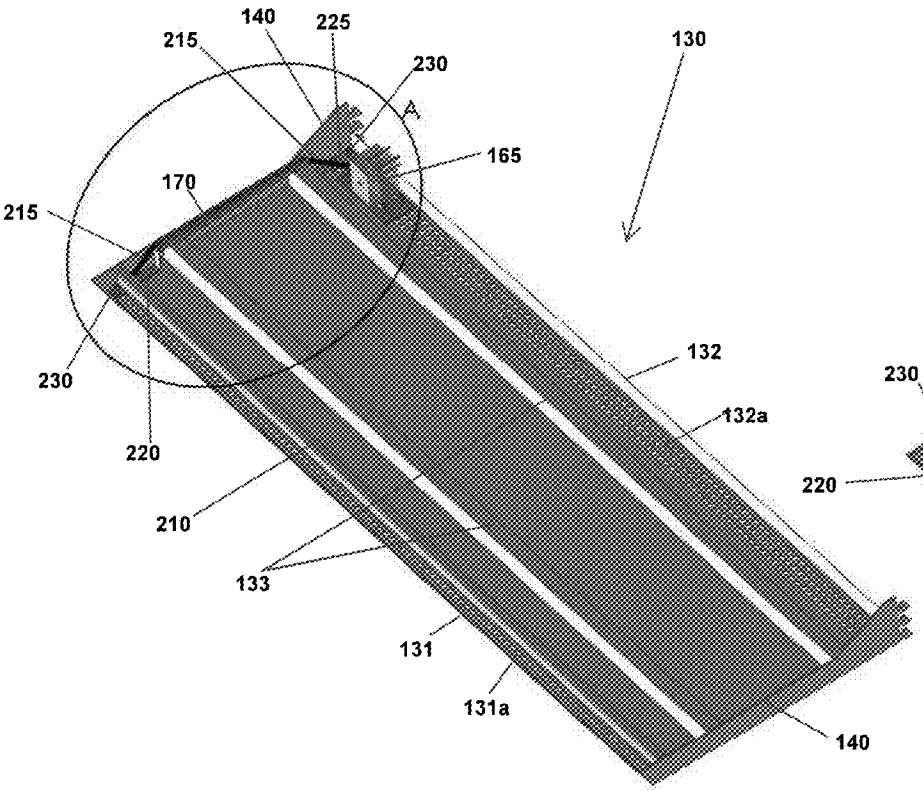
FIG. 3 is a bottom perspective view (looking down from above) showing the electrical connection of an LED strip by a B-plug and wire tube of the present disclosure.

FIG. 3 is a bottom view (looking down at bottom) of shelf 130 and FIG. 3A is an enlarged view of section "A" of FIG. 3. FIG. 3A shows in detail the electrical connections between LED device 210, electrical cord 215, wire tube 170 and B-plug 165. All of LED device 210, electrical cord 215, wire tube 170 and B-plug 165 are insulated as will be discussed in conjunction with other FIGS., and all of LED device 210, electrical cord 215, wire tube 170 and B-plug 165 are either assembled with shelf 130 in advance of installation, as an integrated unit, or installed at the site. The positions of LED device 210, electrical cord 215 and wire tube 170 and B-plug 165 can be adjusted at the installation site before shelf 130 is placed onto gondola 100. B-plug 165 is secured to shelf 130 via pushpins 230 inserted into back holes 132*a* proximal back edge 132 of shelf 130. As mentioned previously, wire tube 170 is secured to shelf 130 at front foot 220 and rear foot 225 also by pushpins 230 inserted into front holes 131*a* and rear holes 132*a*, respectively. Front holes 131*a* and rear holes 132*a* help position wire tube 170 and B-plug 165 accurately with respect to C-channel strip 150. Also, holes 640 on the base panel 610 of B-plug 165 and holes 520 on foot 220 and on foot 225 (see FIGS. 5 and 6) are elliptical in shape which assists in easy installation of front foot 220, rear foot 225 and B-plug 165. B-plug 165 has four electrical poles 300 facing toward pegboard/pegboard support system 125. Electrical poles 300 are inserted directly into C-channel strip 150, which is a fixed to pegboard/pegboard support 125 (as will be described in conjunction with FIG. 4) and connected to a power source (not shown). As will be discussed in conjunction with other FIGS., wire tube 170 is placed alongside inner underside surface of shelf support bracket 140 in order to place B-plug 165 to allow insertion of electrical poles 300 into C-channel strip 150 easily and firmly while holding shelf 130 by shelf support brackets 140. At the same time, wire tube 170 placed alongside inner underside surface of shelf support bracket 140 provides more merchandising space beneath shelf 130, and added protection for electrical cord 215. No wire or electrical cord other than electrical cord 215 is exposed to human touch. During installation, one can hold both shelf brackets 140 and simultaneously insert B-plug 165 electrical poles 300 into left C-channel 151 and right C-channel 152 of C-channel strip 150. Therefore, one can complete installation of shelf 130 onto gondola 100 in a single action while having LED device 210 working immediately.

Figures 4, 4A, 4B, 4C, 4D, 4E:
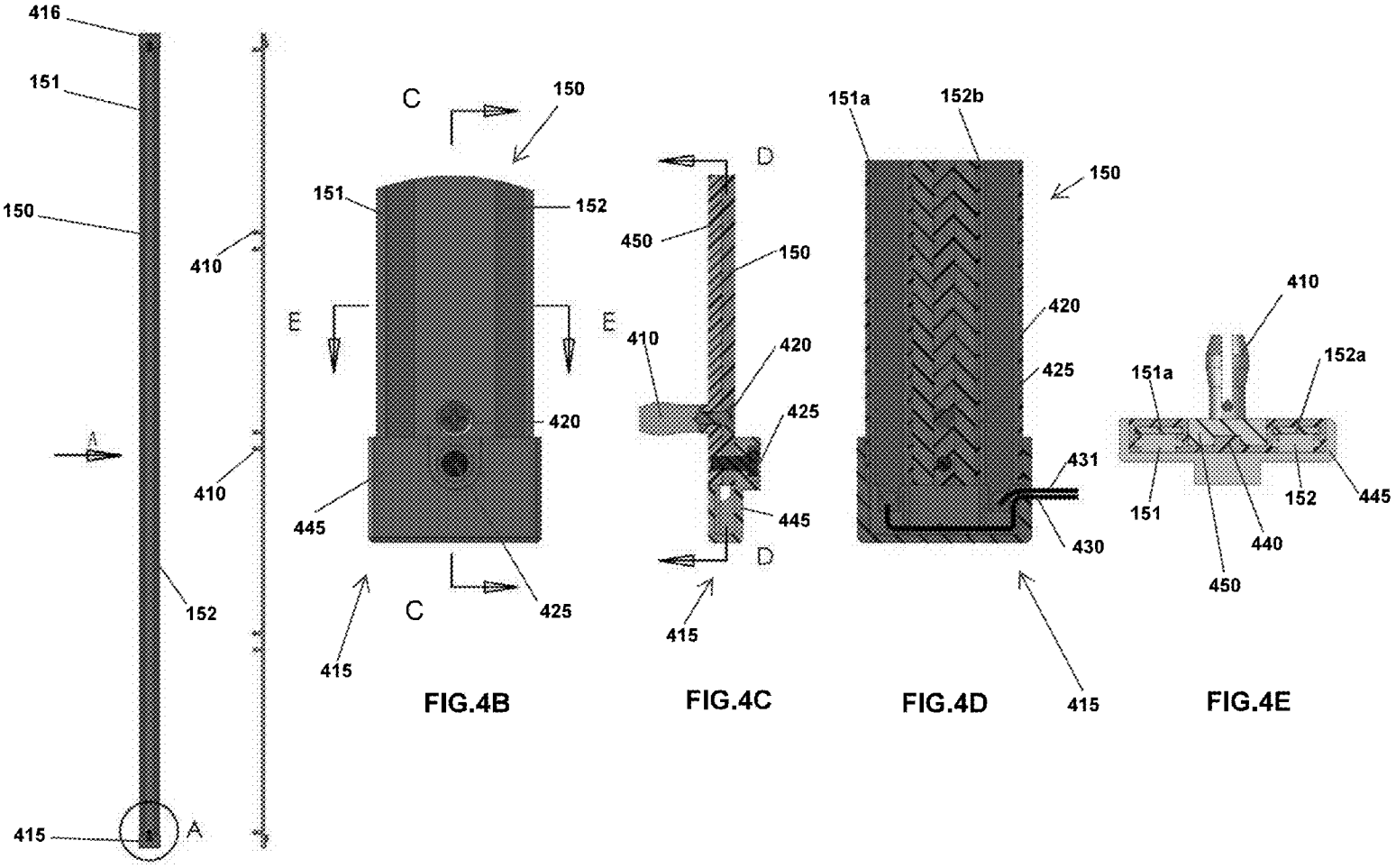
FIG. 4 is a front view of a C-channel strip of the present disclosure.
FIG. 4A is a side view along line "A" of FIG. 4.
FIG. 4B is an enlarged view of section "A" of FIG. 4.
FIG. 4C is a cross-section view through line "C"-"C" of FIG. 4B.
FIG. 4D is a cross-section view through line "D"-"D" of FIG. 4C.
FIG. 4E is a cross-sectional view through line "E"-"E" of FIG. 4B.

FIGS. 4-4E show details of the structure of C-channel strip 150. FIG. 4 shows a front view of C-channel strip 150 having disposed at opposite ends thereof a bottom cap 415 and a top cap 416. One C-channel strip 150 stands vertically aside left gondola upright 110 or right gondola upright 115 and is held in place in pegboard holes 145 by the use of pins 410 that secure C-channel strip 150 to pegboard/pegboard support 125. Preferably, pins 410 are disposed in pairs as shown in FIG. 4A and are spaced so as to occupy vertically adjacent pegboard holes 145 (generally spaced on 1" centers, as is known in the art). Also preferably, each pair of pins 410 is spaced every 24" (or other distance selected as desired) vertically and pins 410 (or each set of two pins 410) are aligned, one atop another. Bottom cap 415 and top cap 416 each has associated therewith a single pin 410. FIG. 4A shows a side view of C-channel strip 150 of FIG. 4. FIG. 4B shows an enlarged detail of section "B" of FIG. 4. FIG. 4B shows one pair of C-channels, i.e., left C-channel 151 and right C-channel 152, each of which comprises a flat and thin conductive panel 151*a* and 152*a*, respectively, made of a conductive material, such as copper or aluminum. C-channel strip 150 is electrically conductive from bottom cap 415 to top cap 416 due to right C-channel 152 and left C-channel 151. Each pin 410 is affixed to C-channel strip 150 and locked thereto by a locking pin 420. Bottom cap 415 (as is top cap 416) is secured to C-channel strip 150 by a locking pin 425. FIG. 4C shows a cross-section of the structure of FIG. 4B through line "C"-"C". FIG. 4D is a cross-sectional view through line "D"-"D" and illustrates the electrical connections from, e.g., power adapter 160 to right C-channel 152 and left C-channel 151. One wire 430 of cord 155 connects to left C-channel 151 from power adapter 160 and one wire 431 of cord 155 connects to right C-channel 152 from power adapter 160. FIG. 4E shows a cross-section through line "E"-"E" of details of the construction and design of C-channel strip 150. C-channel strip 150 comprises one integral C-channel frame 440 that secures left C-channel 151 and right C-channel 152, a plastic cap 445 that encloses connections of wires 430, 431 to left C-channel 151 and right C-channel 152, pin 410 and pin holding base 450. Both conductive left C-channel 151 and right C-channel 152 are insulated by C-channel frame 440 and plastic cap 445. Optionally, other than the use of pins 410, C-channel strip 150 can be affixed onto the wall, pegboard/pegboard support 125 or any surface without a hole for accepting pins 410 by the use of adhesives, tape, or other adhesion methods known to those of skill in the art that can be put on the back of C-channel strip 150 that is placed against a wall or other surface.

Figure 5:
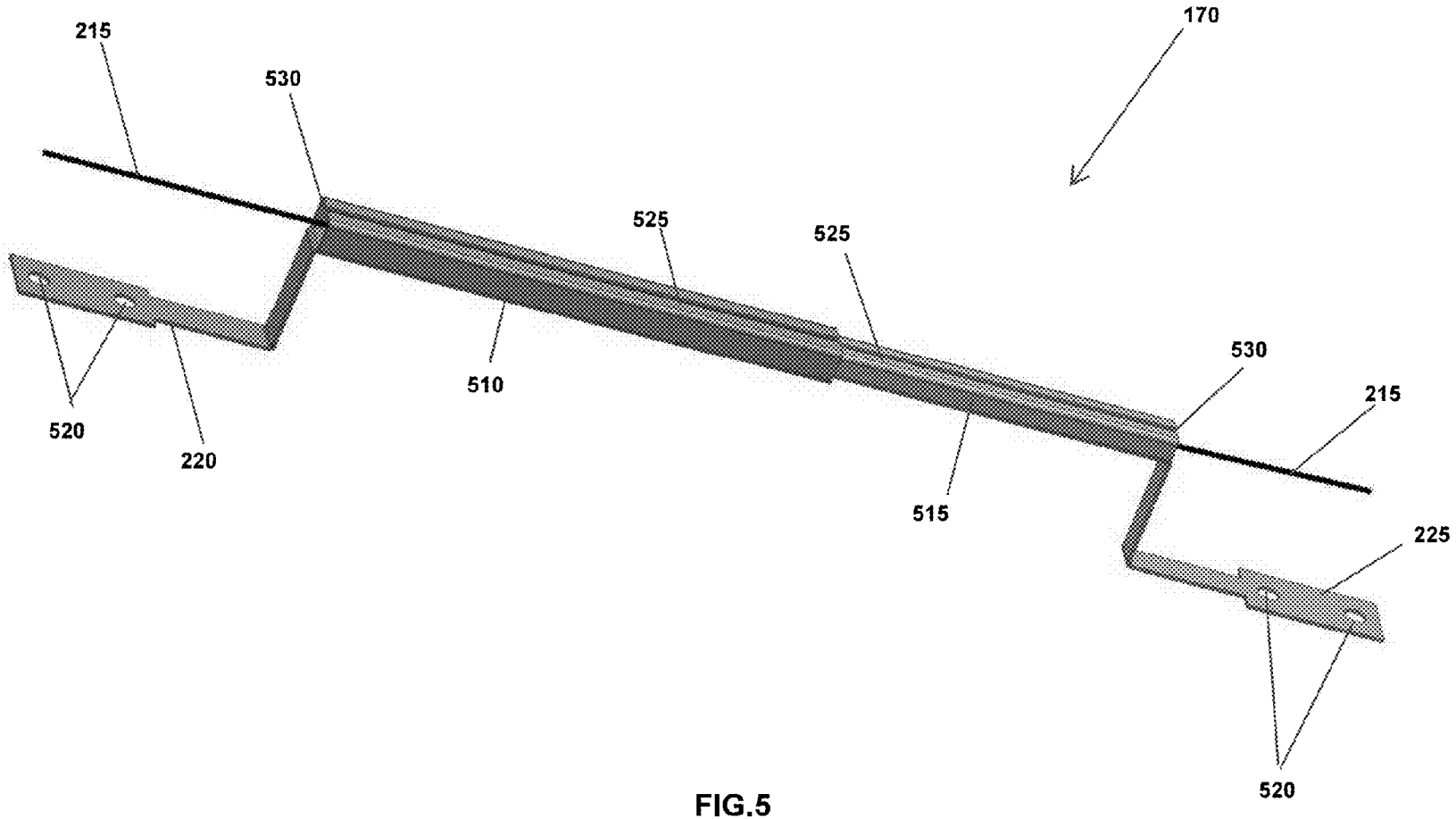
FIG. 5 is a detailed view of a wire tube to of the present disclosure.

FIG. 5 shows the structure of wire tube 170. Wire tube 170 comprises one outer tube 510 and one inner tube 515. Inner tube 515 telescopes within outer tube 510 thereby allowing for easy adaptation of wire tube 170 to various depths of shelf 130 and positions of supporting bars 133. In the embodiments shown in previous FIGS., front foot 220 was associated with outer tube 510 and rear foot 225 was associated with inner tube 515. Of course, these relationships can be easily reversed. In the embodiment shown in FIG. 5, front foot 220 and rear foot 225 each includes two holes 520 for accepting pushpins 230 (see, e.g., FIG. 3A). Of course, the number of holes 520 can be varied according to design choice. Holes 520 are always, generally, elliptical for easy installation. Outer tube 510 and inner tube 515 can, of course, be made of any appropriate material including metal and/or plastic. Electrical cord 215 that provides electric current to LED device 210 passes through wire tube 170, as indicated. In the embodiment shown in FIG. 5, each of outer tube 510 and inner tube 515 have a slot 525, and each slot 525 is configured to be superimposed with respect to the other. Superimposed slots 525 are provided for ease of accepting electrical cord 215 during assembly and installation of shelf 130 and gondola 100. Of course, in a less preferred embodiment, wire tube 170 need not be provided with slots 525 in outer tube 510 and inner tube 515 for accepting electrical cord 215. If slots 525 are not provided, electrical cord 215 may be threaded through the hollow interior 530 of outer tube 510 and inner tube 515.

Figure 6:
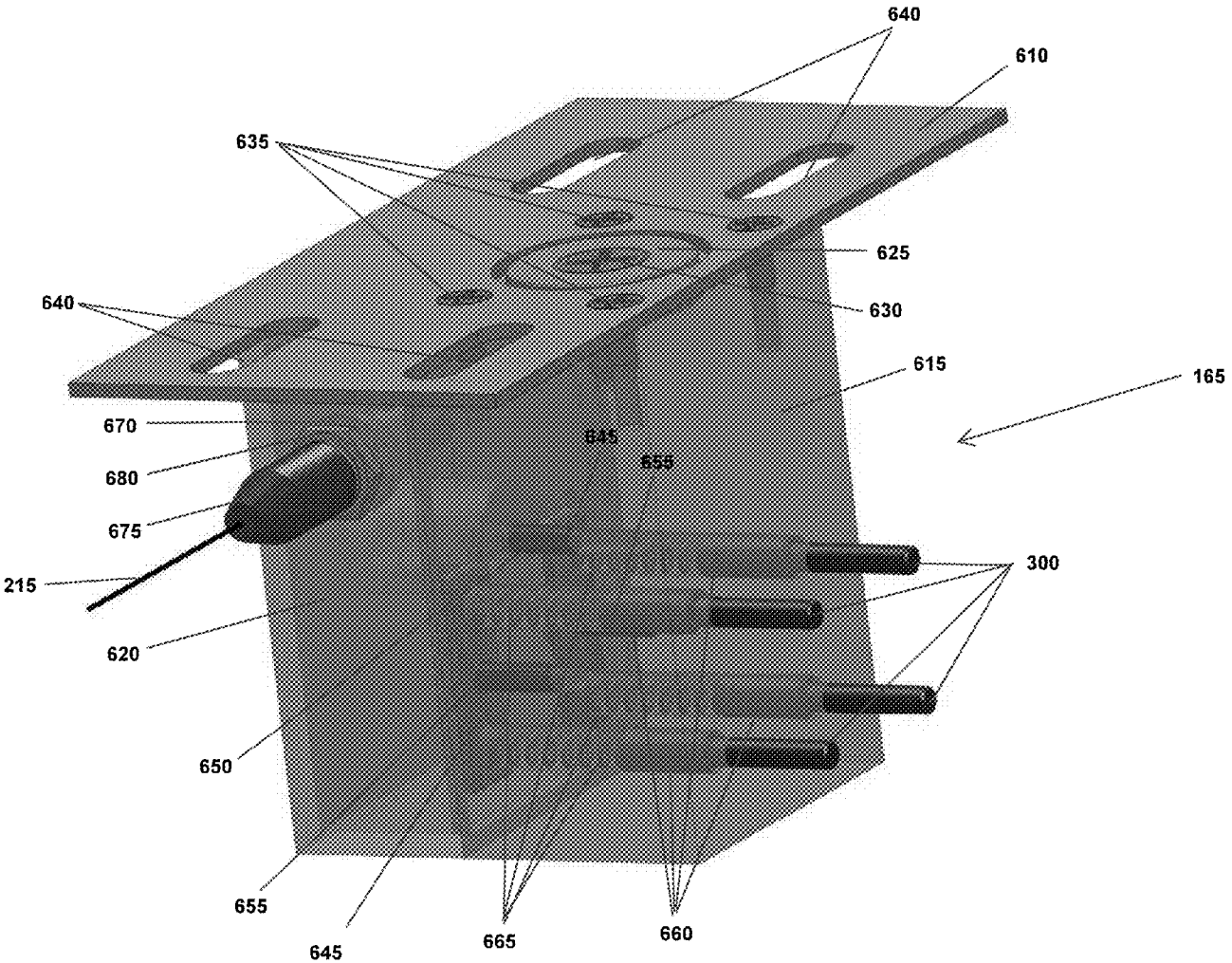
FIG. 6 is a perspective view, in partial "phantom" relief, of a B-plug of the present disclosure.

FIG. 6 shows in perspective view, and in partial "phantom" relief, the detail of the structure of B-plug 165. B-plug 165 comprises a base panel 610, a box 615, a cap 620, and four electric poles 300. Four electrical poles 300 rather than two electrical poles are employed to ensure the contact between C-channel panels 151*a*, 152*a* and electrical poles 300 for conductive purpose. A magnetic ring 625 is secured into place on base panel 610 by a base locking pin 630. In the embodiment shown, base panel 610 is secured to box 615 with four (4) base screws 635. Four holes 640 are also provided in base panel 610 for the insertion of pushpins 230 through holes 640 into matching rear holes 132*a* of shelf 130. Holes 640 are designed in the preferred embodiment as the elliptical slots, thus allowing for alignment of electric poles 300 with left C-channel 151 and right C-channel 152 of C-channel strip 150. Electric poles 300 connect to two (2) conductive panels 645 disposed on a side of box 615 opposite the ends of the electric poles 300. Cap 620 is secured to box 615 using cap screw 650, while conductive panels 645 are secured in place using conductive panel screws 655. Electric poles 300 each have associated with it a conductive head 660 and a conductive spring 665. Conductive head 660 and conductive spring 665 allow for sufficient variation in contact points between electric poles 300 and left C-channel panel 151*a* and right C-channel panel 152*a* of C-channel strip 150, thereby ensuring complete electrical contact between electric poles 300 and left C-channel panel 151*a* and right C-channel panel 152*a* of C-channel strip 150. A socket 670 and a plug 675 are connected to conductive panels 645 via wires 710 (see, FIG. 7) affixed to electric tabs 715 (see, FIG. 7) of socket 670. Threaded end 720 of socket 670 passes through a hole 725 (see, FIG. 7) in outer wall 730 (see, FIG. 7) of cap 620. Electrical cord 215 is provided as part of plug 675 during manufacture. Socket 670 and plug 675 are secured in place via retaining nut 680. Once installed, electric current passes from power adapter 160 through cord 155 into wires 430, 431 and into left C-channel panel 151*a* and right C-channel panel 152*a*, respectively. Thereafter, electric current passes from left C-channel panel 151*a* and right C-channel panel 152*a* to electric poles 300 and conductive head 660 and conductive springs 665 to conductive panels 645. Following that, the electric current passes through wires 710 (see, FIG. 7) to electrical tabs 715 (see, FIG. 7) and socket 670 to plug 675 and electrical cord 215, supplying electric current to LED device 210.

Figure 7:
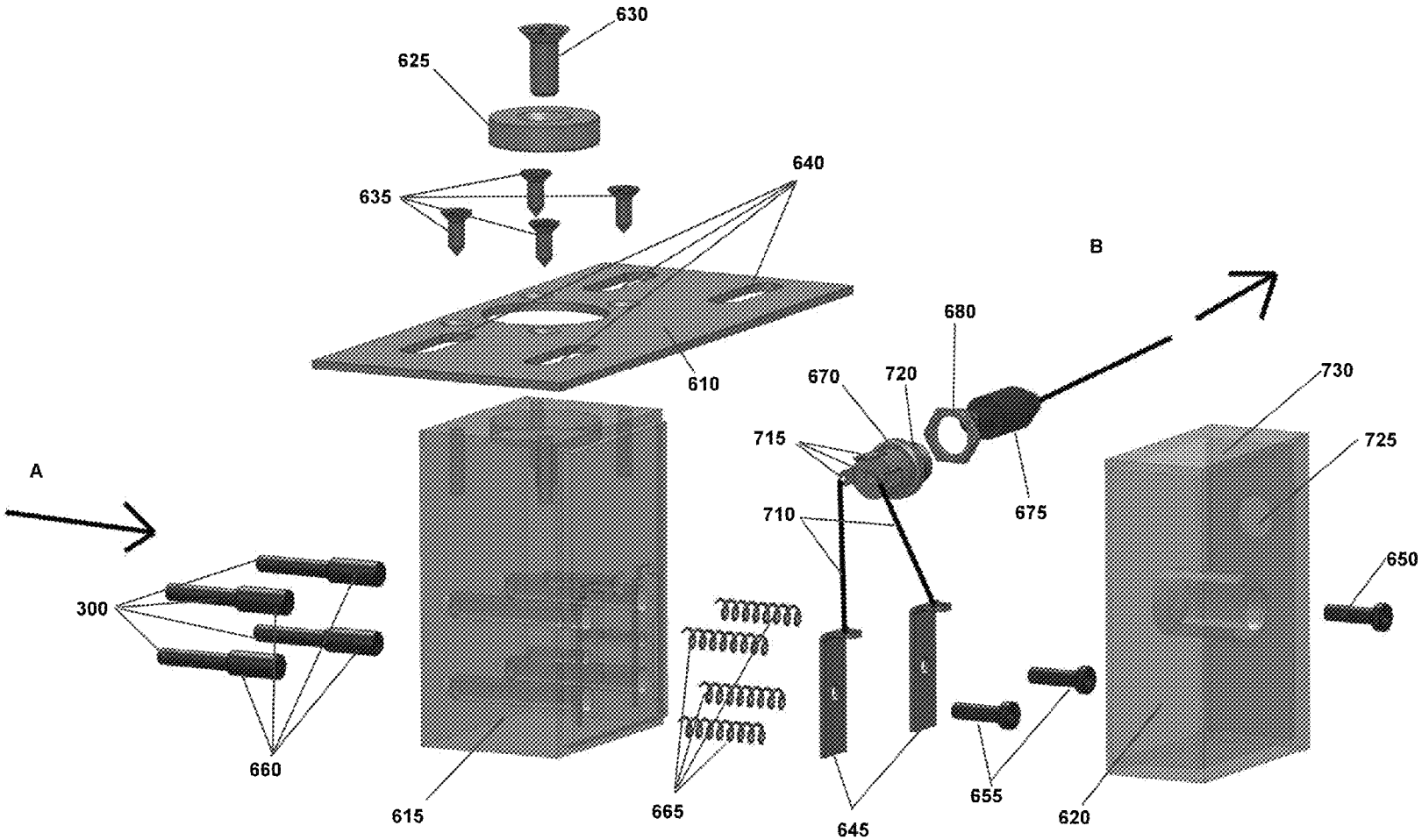
FIG. 7 is an exploded view of the B-plug of FIG. 6.

FIG. 7 is an exploded view of B-plug 165, with elements of B-plug identified and showing the flow of electric current in the direction of arrow A (DC 24V) from left C-channel 151 and right C-channel 152 through B-plug 165 and out through arrow B to LED device 210.

The dimensions of C-channel strip 150 are designed to fit a standard peg board/pegboard support 125 holes in which the center-to-center distance of the holes is 1", both vertically and horizontally. Also standard, the diameter of each hole is ¼". Thus, for example, C-channel strip 150 can be 24" or other length, 1" or less in width and approximately ¼" thick or less. These dimensions can be adjusted to suit gondola systems of various manufacturers. The dimensions of B-plug 165 are based upon the dimensions of the matching C-channel strip 150. The selection of the appropriate thickness of C-channel strip 150 is such as to accommodate the gap that is present between rear edge 132 of shelf 130 and the surface of pegboard/pegboard support 125 when support brackets 140 are inserted into support slots 135. It is a critical requirement to have a thin C-channel strip 150 to adapt to the narrow gap of about ¼" or less between rear edge 132 of shelf 130 and the surface of wall of gondola. Thus, C-channel strip can accommodate standard shelf/bracket and gondola tolerances (i.e., spacing between rear edge 132 of shelf 130 and surface of wall of gondola), without modification of the shelf/bracket dimensions to allow for placement of the C-channel strip. In operation, the low-voltage plug and play display system of the present disclosure is designed to provide LED lighting to standard shelving, achieving three goals: (1) to be able to install a shelf onto a gondola by inserting shelf brackets into a gondola upright in a single action; (2) to provide electrical wiring wherein, visually, no wire or cord is exposed (in this regard, C-channel strip 150 and B-plug 165 are important aspects to this goal, as is wire tube 170 that houses electrical cord 215); and (3) all conductive parts must be insulated and/or disposed away from possible contact by installation personnel and/or persons buying merchandise placed on the shelves.

An alternative embodiment of the present disclosure will now be described in conjunction with FIGS. 8-14, below.

FIG. 8 shows a front view of gondola system 100 comprising left upright 110, right upright 115, pegboard/pegboard support system 125, deck 120 and shelf 130. FIG. 8A is an overhead view of a cross-section through line "A"-"A" of FIG. 8, showing the joint of shelf bracket 140, right gondola upright 115, a plastic inner upright 810 and an alternative B-plug 840. FIG. 8B is an enlarged view of section "B" of FIG. 8A showing the details of plastic inner upright 810 placed within right gondola upright 115. Two vertical conductive strips, right conductive strip 815 and left conductive strip 820 pass the length of plastic inner upright 810 from top to bottom. Right conductive strip 815 and left conductive strip 820 are separated and insulated from one another by right plastic inner upright wall 825, left plastic inner upright wall 830 and center tab 835. As can be seen from FIG. 8B, plastic inner upright 810 has a mirror image opposing side that is provided to accommodate those instances where gondola system 110 is provided with shelves 130 on both side of pegboard/pegboard support system 125. Adjustable electric poles 845 of B-plug 840 connect to right and left conductive strips, 815 and 820, respectively. B-plug 840 is connected to holes 132*a* proximal rear edge 132 of shelf 130 using push pins 230 in a manner similar to that described with respect to FIG. 2A. Shelf bracket hooks 141 (see, FIG. 9B) are separated from contact with adjustable electric poles 845 by a distance, due to the "offset" configuration and design of B-plug 840 as will be discussed in conjunction with, e.g., FIGS. 9-11 and 13-14. Right gondola upright 115 is separated from adjustable electric poles 845 by plastic electric pole holder 850 that inserts into and through support slot 135 and allows adjustable electric poles 845 to contact right conductive strip 815 and left conductive strip 820 without contacting right upright 115. All of right conductive strip 815, left conductive strip 820 and adjustable electric poles 845 are insulated as will be understood and appreciated by those skilled in the art from the previous discussion. Inner upright 810 is inserted into right gondola upright 115 (in the embodiment described in FIG. 8) from the top. Generally, gondola uprights have an empty core forming a space. The shape, structure and dimensions of inner upright 810 can be selected to fit the gondola upright according to manufacturer to thus ensure proper and insulated conductive connections between adjustable electric poles 845 and right and left conductive strips 815 and 820, respectively.

Figure 9:
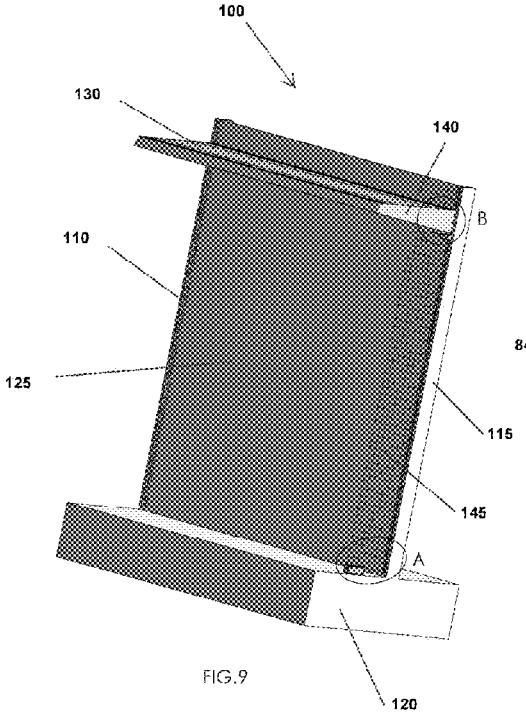
FIG. 9 is a right side perspective view of the gondola of FIG. 8.
Figure 9B:
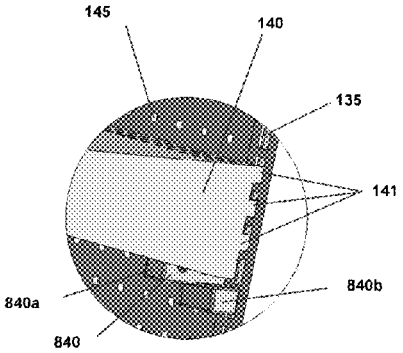
FIG. 9B is an enlarged view of section "B" of FIG. 9.
Figure 9A:
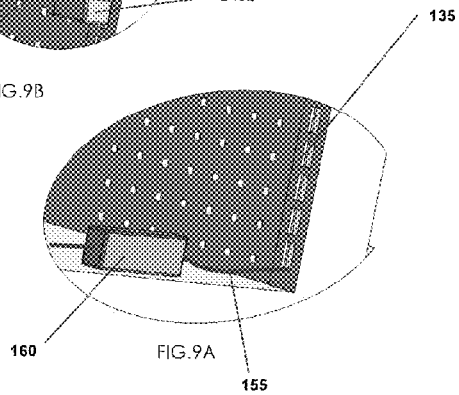
FIG. 9A is an enlarged view of section "A" of FIG. 9.

FIG. 9 shows a right side perspective view of the gondola of FIG. 8. FIG. 9A shows an enlarged section "A" of FIG. 9, and is generally similar to FIG. 1A discussed above. FIG. 9A shows power adapter 160 that converts AC 110V or other high voltage AC power to DC 24V or other low voltage DC power and supplies the DC 24V power via wires 155 to right and left conductive strips 815 and 820, respectively, in inner upright 810, as will be described in more detail in conjunction with FIG. 12. Generally, the AC 110V power supply source and power adapter 160 are placed out of view under gondola deck 120 and are connected by wires 155 from power adaptor 160 to right and left conductive strips 815 and 820. FIG. 9B shows an enlarged section "B" of FIG. 9 showing shelf bracket 140 and B-plug 840 positions. B-plug 840 is firmly attached to the inner side of shelf bracket 140 by permanent magnet rings or other methods as will be further described in conjunction with, e.g., FIGS. 13-14. For descriptive purposes, B-plug can be considered to have two sections, upper section 840*a* and lower section 840*b*. Upper section 840*a* is affixed to inner side of shelf bracket 140. Lower section 840*b* is designed and constructed in the embodiment shown as disposed below and offset to upper section 840*a*. This design of B-plug 840 allows for lower section 840*a* that includes adjustable electric poles 845 to contact adjustable electric poles 845 with right and left conductive strips 815 and 820 yet have adjustable electric poles 845 enter inner upright 810 below the lowest bracket hook 141 so that adjustable electric poles 845 insert into the support slot 135 closest to the lowest bracket hook slot 141 to maintain aesthetic appeal and still connect to right and left conductive strips 815 and 820 when shelf bracket 140 engages support slots 135 of gondola upright 115.

Figure 10:
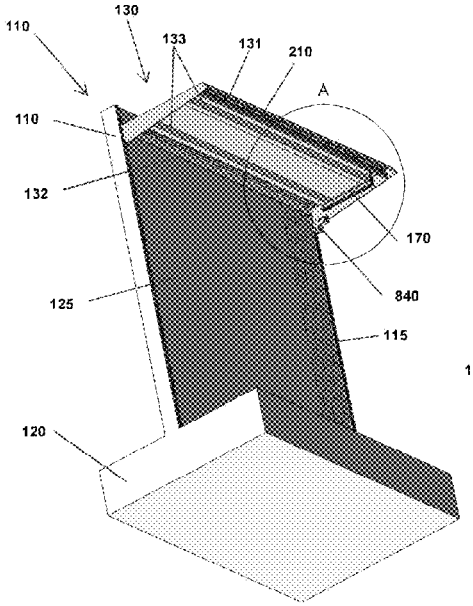
FIG. 10 is a bottom view of the gondola of FIG. 8.
Figure 10A:
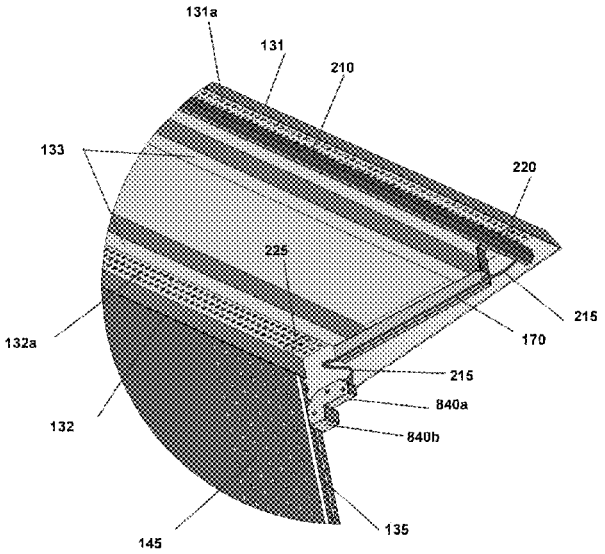
FIG. 10A is an enlarged view of section "A" of FIG. 10.

FIG. 10 shows a bottom view of the gondola system 110. FIG. 10A shows an enlarged section "A" of FIG. 10. FIGS. 10 and 10A show the electric connections generally shown in FIGS. 2 and 2A, with the only differences being B-plug 840 rather that B-plug 165 and the use of inner upright 110 rather than C-channel 150 and conductive strips 151 and 152.

Figure 11:
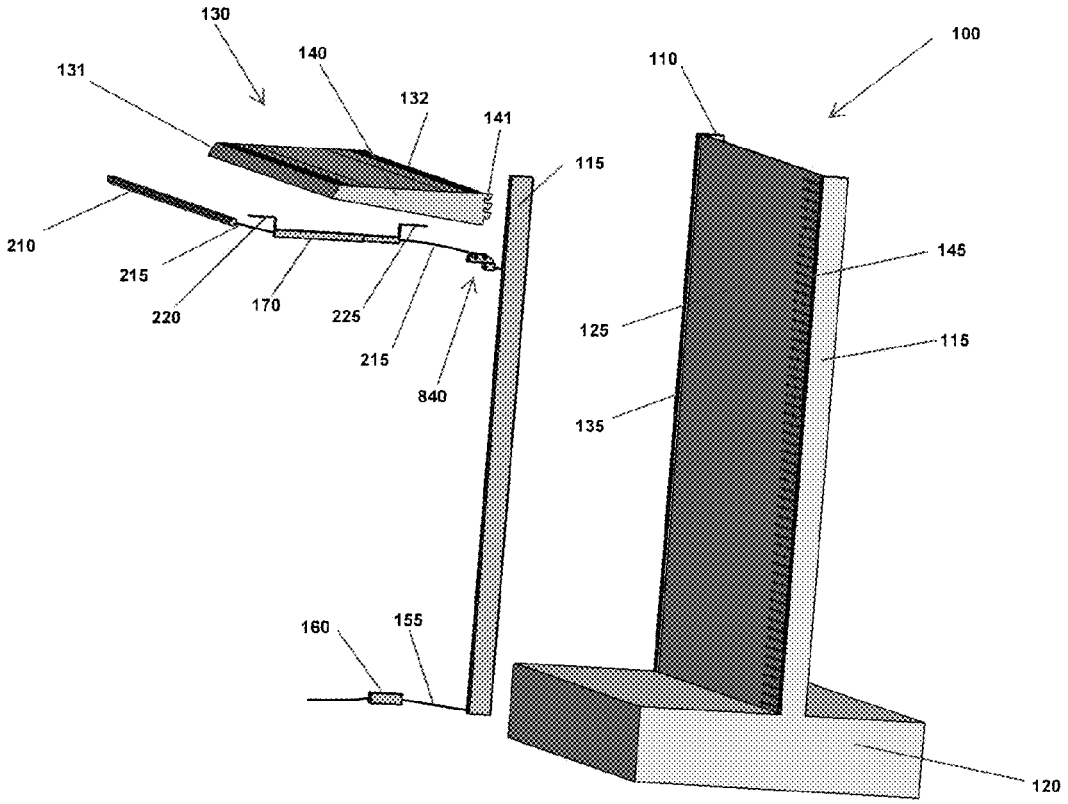
FIG. 11 is an exploded view of the gondola assembly of FIGS. 8-10.

FIG. 11 is an exploded view of the gondola system of FIGS. 8-10 with like elements denoted by like numerals.

Figure 12:
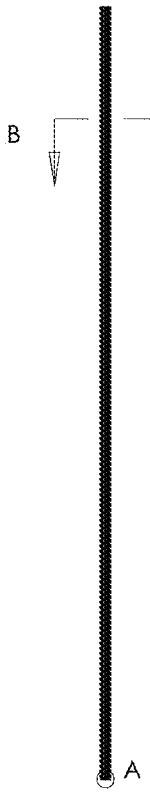
FIG. 12 is a side view of an inner upright of the first alternative embodiment of the present disclosure.
Figure 12A:
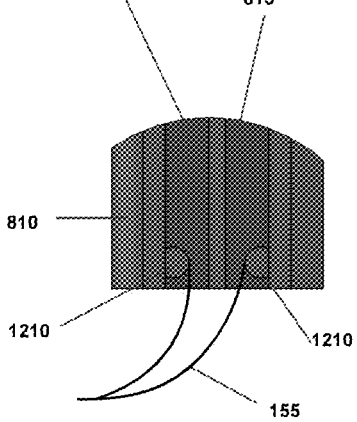
FIG. 12A is an enlarged view of section "A" of FIG. 12.
Figure 12B:
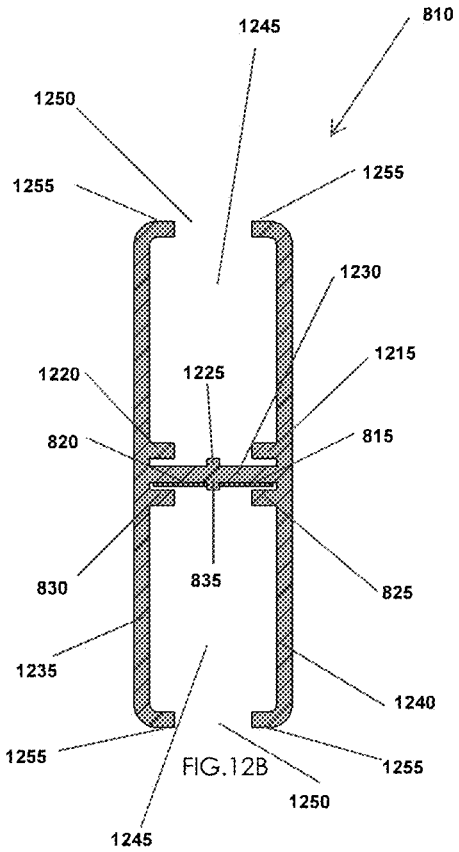
FIG. 12B is an enlarged cross section view through line "B"-"B" of FIG. 12.

FIG. 12 is a front view of inner upright 810. FIG. 12A is an enlarged view of section "A" of FIG. 12 showing the detailed structure of the electric connections of wires 155 to right and left conductive strips 815 and 820 disposed in inner upright 810. The two vertical conductive strips, right and left conductive strips 815 and 820 run the length of inner upright 810 and are connected to DC24V or other low DC voltage by wires 155 from power adapter 160 (not shown) and insulated by the plastic tabs 1210 of inner upright 810. A socket connecting the conductive strips 815 and 820 to wires 155 is placed at the bottom of inner upright 810 before installation. The plug of the adapter output cord comprises two wires 155 inserted into the socket. This connection is done before the inner upright is inserted into the gondola upright, and wires 155 are simply retrieved and brought out from gondola upright slot 135 proximal deck 120. FIG. 12B is a cross-section of a preferred inner upright 810 through line "B"-"B" of FIG. 12. This preferred inner upright 810 was first described with respect to FIG. 8B. As was described in FIG. 8B with respect to the preferred embodiment of inner upright 810, right conductive strip 815 and left conductive strip 820 are separated and insulated from one another by right plastic inner upright wall 825, left plastic inner upright wall 830 and center tab 835. As can be seen from FIGS. 8B and 12B, plastic inner upright 810 has a mirror image opposing side that is provided to accommodate those instances where gondola system 110 is provided with shelves 130 on both sides of pegboard/pegboard support system 125. In FIG. 12B, the mirror images of right plastic inner upright wall 825, left plastic inner upright wall 830 and center tab 835 have been designated 1215, 1220 and 1225, respectively. The mirror images of inner upright 810 are separated by central wall 1230. As shown in FIG. 12B, inner upright 810 has left C-shape wall 1235 and right C-shape wall 1240. All portions of inner upright 810 are made of plastic non-conductive material. Left C-shape wall 1235 and right C-shape wall 1240 in conjunction with central wall 1230 form two chambers 1245, with one opening 1250 of each chamber matching the gondola upright slots 135. In the preferred embodiment, opening 1250 is no larger than the gondola upright slot 135. Right plastic inner upright wall 825, left plastic inner upright wall 830 and center tab 835 are designed so as to separate left conductive strip 820 from right conductive strip 815 and to form a channel to insert conductive strips 815 and 820. In the embodiment shown in FIGS. 8B and 12B, there are four channels for four conductive strips, i.e. two channels per chamber to place two conductive strips, one in each channel. All channels and chambers are insulated spaces. Dimensions of the inner upright 810 are designed to match the gondola upright, e.g., 110 and 115. Dimensions of right plastic inner upright wall 825, left plastic inner upright wall 830 and center tab 835 are selected to form a comfortable and reliable channel in which to place conductive strips 815 and 820. The insulated chamber is designed to accept the adjustable electric poles 845 of B-plug 840. In the embodiment of inner upright 810 shown in FIGS. 8B and 12B, left C-shape wall 1235 and right C-shape wall 1240 have curved edges 1255 to simplify insertion into gondola uprights. In an alternative embodiment, opening 1250 can traverse the entire length of inner upright 810 to simplify design costs and ensure matching with gondola upright slots 135.

The shape, structure and dimensions of the inner upright 810 can be selected to fit any particular gondola upright and to ensure the conductive connections between adjustable electric poles 845 and conductive strips 815 and 820. For example, the conductive strips can be placed on the left C-shape wall 1235 and right C-shape wall 1240 in cooperation with specially designed adjustable electric poles 845 of B-plug 840.

Figure 13:
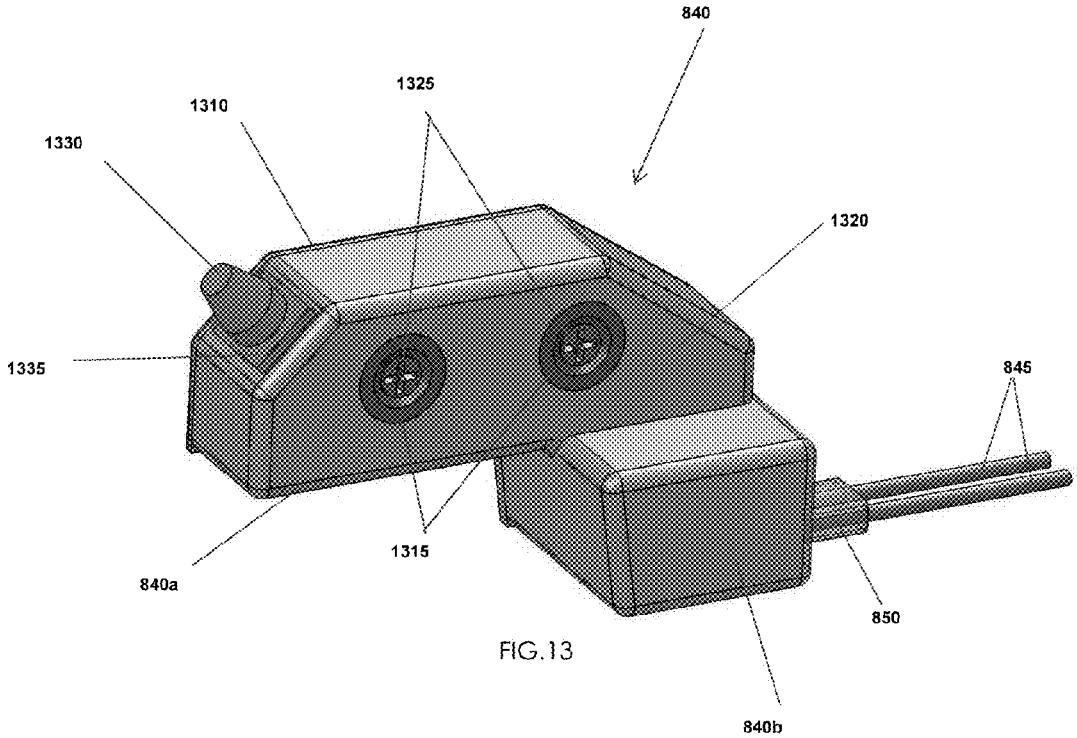
FIG. 13 is a right side perspective view of a B-plug of the first alternative embodiment of the present disclosure.

FIG. 13 shows a right side perspective view of B-plug 840 of the alternative embodiment of the present disclosure. While similar in concept and function to B-plug 165 shown and described with respect to FIGS. 6-7, alternative B-plug 840 is designed specifically for use with inner uprights 810. B-plug 840 has upper section 840*a* and lower section 840*b*, the functions of which were described in detail in conjunction with FIG. 9B. B-plug 840 is a multi-faced design having a plastic vertical side cap 1310 (also shown in FIG. 14). There is a pair of adjustable electric poles 845 that are deployed in conjunction with plastic electric pole holder 850. As described in conjunction with FIG. 9B, electric pole holder 850 provides adjustable electric poles 845 with strong support as well as to providing adjustable electric poles 845 insulation from making electrical contact with metal gondola upright (e.g., 115). A plurality (two shown in FIGS. 13-14) of magnet rings 1315 are placed on one side wall of B-plug box 1320 as shown in FIG. 13. Magnet rings 1315 provide for attachment of upper section 840*a* of B-plug 840 on the inner side of shelf bracket 140. Magnet rings 1315 are strong permanent magnets, and in the embodiment shown in FIG. 13 are held in place by screws 1325. There are other methods by which to attach B-plug 840 on the inner side of shelf bracket 140 that will be apparent to those of skill in the art, such as brazing, gluing, screwing, as well as other attachment methods. The output plug 1330 and output socket 1335 are located at the position as shown in FIG. 13 so as to provide low voltage DC current to electric wire 215 (not shown) to LED strip 210 via wire tube 170, as that current is conducted from right conductive strip 815 and left conductive strip 820 via adjustable electric poles 845, as will be more fully described in conjunction with FIG. 14. The shape, structure and dimensions of B-plug 840 in this preferred embodiment are designed for the best fitting, spacing and performance in the embodiment shown. If conductive strips are placed on the left C-shape wall 1235 and right C-shape wall 1240 in cooperation with specially designed adjustable electric poles 845 of B-plug 840, B-plug 840 will be designed to adapt to those changes, as will be apparent to those of skill in the art.

Figure 14:
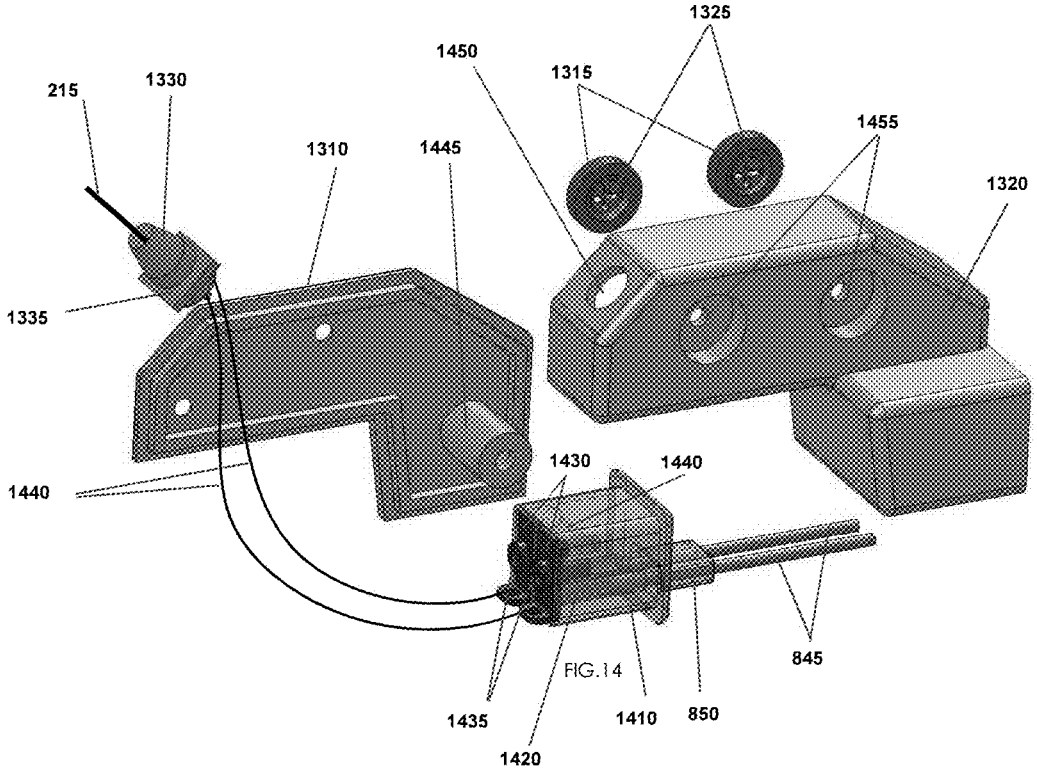
FIG. 14 is an exploded view of the B-plug of FIG. 13 of the first alternative embodiment of present disclosure.

FIG. 14 shows an exploded view of the B-plug 840 of FIG. 13. B-plug 840 includes plastic B-plug box 1320, plastic vertical side cap 1310, a plastic electric pole case 1410, output plug 1330, output socket 1335, magnet rings 1315 and screws 1325. As shown in FIG. 14, the adjustable electric pole combination comprises plastic electric pole case 1410 with plastic electric pole holder 850, one pair of adjustable electric poles 845, two springs 1420 (one at the base of each adjustable electric pole 845), one pair of conductive panels 1430 with screws 1435, and one locking hole 1440. One end of each spring 1420 connects to one of each of the conductive panels 1430, and the other end of each spring 1420 contacts one of each of the adjustable electric poles 845. The conductive panels 1430 are connected to the rear wall of electric pole case 1410 by screws 1435. Wires 1440 accept electric current from adjustable electric poles 845 via springs 1420 and conductive panels 1430 and conduct current to output plug 1330 and outlet socket 1335, as shown in FIG. 14, and provide electric current to wire 215. Electric pole case 1410 attaches on the plastic vertical side cap 1310 by inserting locking pin 1445 of the plastic vertical side cap 1310 into locking hole 1440 of electric pole case 1410. Output socket 1335 is placed in the socket hole 1450 located on the left upper side of B-plug box 1320 as shown in FIG. 14. Magnetic rings 1315 are affixed onto magnet ring slots 1455 in the wall of B-plug box 1320 by screws 1325 as shown in FIG. 13. The total length of springs 1420 and adjustable electric poles 845 are designed to ensure the conductive connection between adjustable electric poles 845 and right conductive strip 815 and left conductive strip 820 of inner upright 110 when shelf bracket 140 engages gondola upright (e.g. 115). The total length of springs 1420 and adjustable electric poles 845 can be adjusted by different spring lengths to adapt the positions of gondola upright (e.g., 115) and shelf bracket 140. The shape, structure and dimensions of B-plug 840 are designed for the best fitting, spacing and performance in cooperation with gondola system 100 and to ensure the conductive connections between the adjustable electric poles 845 of B-plug 840 and right conductive strip 815 and left conductive strip 820 of inner upright 810. In short, plug and play can be accomplished when shelf bracket 140 engages gondola upright 115. The basic design and structure of B-plug 840 in this alternative embodiment of the present disclosure are principally functionally the same as in the embodiment described with respect to FIGS. 1-7, above.

A second alternative embodiment of the present disclosure will now be described in more detail in conjunction with FIGS. 15-18, below.

Figure 15:
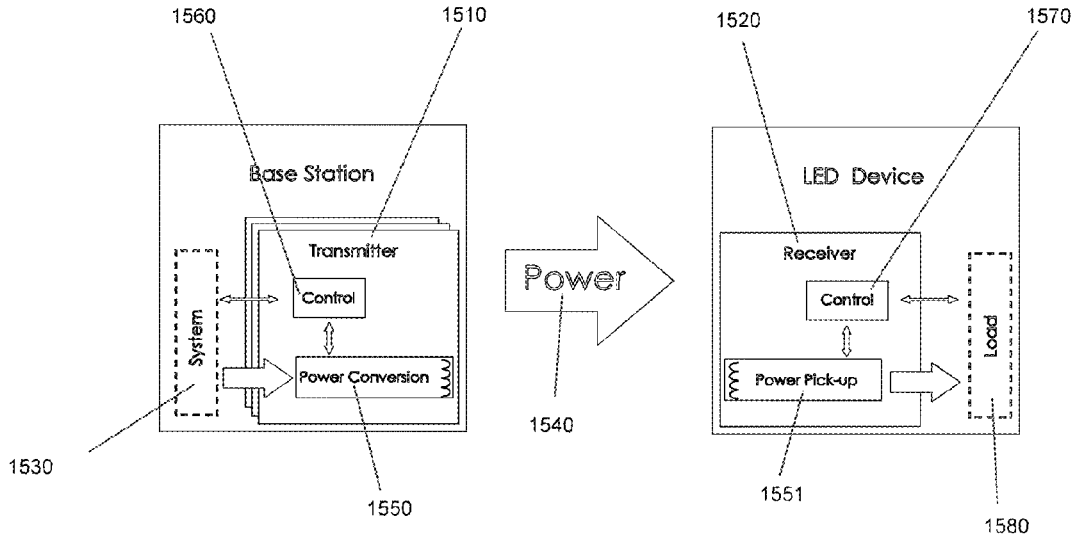
FIG. 15 is a schematic diagram of a wireless power transfer system diagram of the second alternative embodiment of the present disclosure.

FIG. 15 shows a power transfer system diagram of the mechanism of wireless power transfer comprising, in general, two parts: a transmitter (TX) 1510 and a receiver (RX) 1520. Transmitter (TX) 1510 receives power, AC or DC, from a system source 1530. In the present disclosure, power is generally DC12V or other lower DC voltage that has been converted by an adaptor, e.g., adapter 160 (see, FIGS. 1A and 15A) from an AC 110V or other higher voltage system source 1530 is used. Power Conversion 1550 converts electrical power to wireless power signal. Transmitter (TX) 1510 generally comprises transmitter TX control 1560, TX coil 1590 (see, FIG. 15A) with capacitor-resonance circuit that provides power 1540 to RX coil 1595 (see, FIG. 15A) with capacitor-resonance circuit of receiver (RX) 1520 via inductive coupling. TX control 1560 handles signal generation, electric switching and other functions. TX coil 1590 and capacitor-resonance circuit are designed for power transfer, as is known in the art. Receiver (RX) 1520 generally comprises RX control 1570, RX coil 1595 with capacitor-resonance circuit to receive power from (TX) coil 1590 via inductive coupling. RX control 1570 provides functions of ballast, wave filter, voltage stabilization and other functions. RX coil 1595 and capacitor-resonance circuit are designed for power reception or power pick-up, as is known in the art. Power Pick-Up 1551 converts wireless power signal to electrical power. In short, receiver (RX) 1520 controls providing power to output load 1580 (e.g., LED device 210), transmitter (TX) 1510 provides power for transfer, and inductive coupling between the TX coil 1590 and RX coil 1595 transfers power. DC12V is loaded by RX receiver 1520 and conducted to, e.g., LED device 210.

Figure 15A:
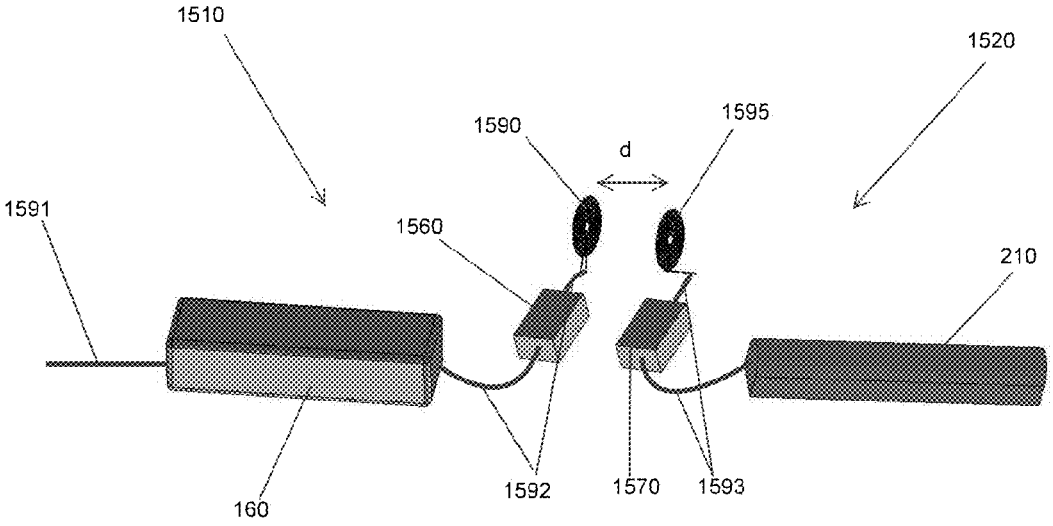
FIG. 15A is a perspective view of a wireless transfer power system transmitter and receiver of the present disclosure.

FIG. 15A shows a structure for wireless power transfer according to the present disclosure. Adaptor 160 converts an AC110V or other higher AC voltage coming from wire 1591 to DC12V or other low DC voltage and provides that lower voltage to wires 1592. Transmitter (TX) 1510 receives DC12V current from adaptor 160 via wire 1592 and transfers power 1540 via inductive coupling to RX receiver 1520 after TX control 1560 performs its functions. Receiver (RX) 1520 receives power transferred from transmitter (TX) 1510 by RX coil 1595 via inductive coupling, and then receiver (RX) 1520 conducts low DC voltage "working current" to, e.g., LED device 210 via wires 1593 after RX control 1570 performs its functions. The working distance "d" between transmitter (TX) 1510 and receiver (RX) 1520 will be dictated by the strength of the inductive coupling between transmitter (TX) 1510 and receiver (RX) 1520. For example, in general for the embodiment shown in, e.g., FIGS. 16-17, distance "d" may be around 4". However, it is possible to have transmitter (TX) 1510 and receiver (RX) 1520 at other distances, and when the strength of in inductive coupling is properly selected and positioned distance "d" could be greater. In fact, it is envisioned that transmitter (TX) 1510 could be located at a remote location, and that receiver (RX) could be incorporated in, or affixed to, the load, e.g., LED device 210, so that vertical strip 1610 and receiver box 1630 (see, e.g., FIG. 16), and the associated wiring and structure, described with respect to FIGS. 16-17 such as, e.g., wire tube 170, can be eliminated.

Figure 15B:
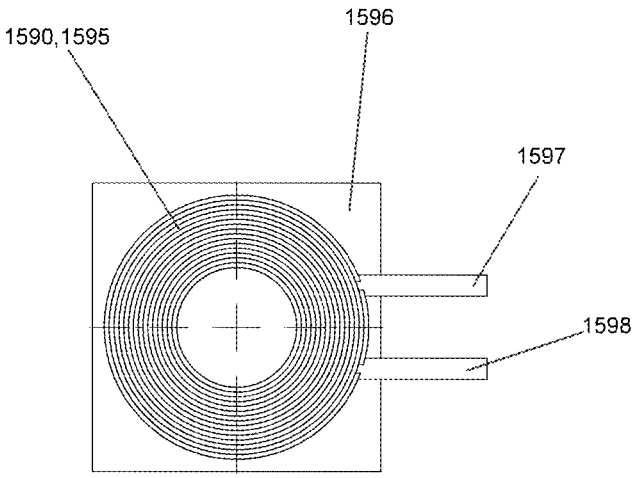
FIG. 15B is a front view of a receiver/transmitter coil with electrical leads of the present disclosure.
Figure 15C:
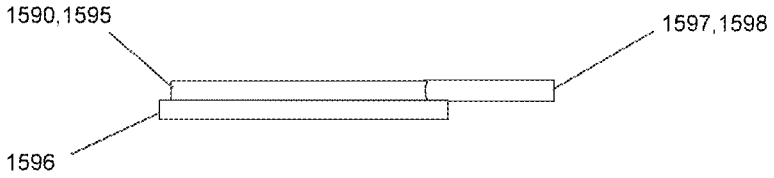
FIG. 15C is a side view of the receiver/transmitter coil of FIG. 15B.

FIG. 15B shows a front view of TX/RX coil 1590/1595 on a support 1596. TX/RX coil 1590/1595 is connected to electric leads 1597 and 1598 that will be explained in more detail with respect to FIGS. 16-16B. FIG. 15C shows a side view of TX/RX coil 1590/1595 on support 1596 and leads 1597/1598.

Although TX coil 1590 and RX coil 1595 are shown as planar circular coils in FIGS. 15A-15C, the specifications of the coil(s) can be designed to meet the requirements of the system and load. Planar coils or other coil designs can be selected as well as their dimensions. Coils can be made from solid conductive materials or can be printed on special paper, as is known in the art. Therefore, this alternative embodiment can be used for new gondola systems or retrofitting existing gondola systems.

Figure 16:
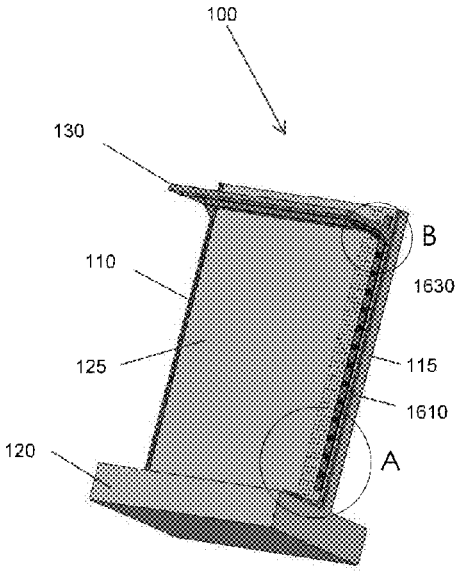
FIG. 16 is a front right side perspective view of a gondola, shelf, and vertical transmitters strip showing the wireless power transfer system of the second alternative embodiment of the present disclosure.
Figure 16B:
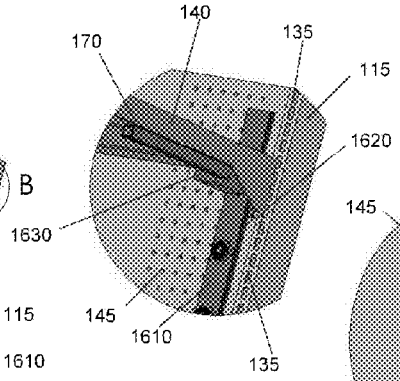
FIG. 16B is an enlarged view of section "B" of FIG. 16.
Figure 16A:
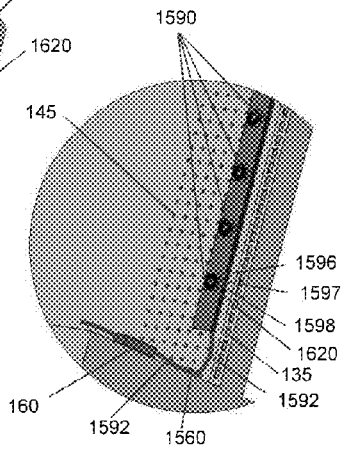
FIG. 16A is an enlarged view of section "A" of FIG. 16.

FIG. 16 shows a typical gondola system 100 comprised of left gondola upright 110, right gondola upright 115, deck 120, pegboard/pegboard support system 125, and at least one shelf 130. Each gondola upright 110, 115 includes a set of evenly spaced support slots 135 for accepting shelf support brackets 140, as is standard in the art. Pegboard/pegboard support system 125 includes substantially evenly spaced horizontal rows and vertical columns of pegboard holes 145. Also shown in FIG. 16 is a transmitter (TX) strip 1610 that affixes vertically to pegboard/pegboard support 125 by double-faced adhesive tape or other methods. FIG. 16A shows the electrical connections made by a wires 1592 between power adapter 160 and transmitter (TX) strip 1610. Power adapter 160 converts AC 110V-220V or other AC voltage (from a source not shown) to low-voltage DC 12V or other DC current. The low-voltage DC 12V or other DC current is conducted to wires 1620 running along an edge of transmitter (TX) strip 1610 through TX control 1560 for transfer to TX coil 1590 on support 1596 through leads 1597/1598. DC 12V current will be provided by power transfer through TX coil(s) 1590 and inductive coupling between transmitter (TX) 1510 and receiver (RX) 1520 to RX coil 1595 and is conducted through receiver (RX) control 1570 and, via wire tube 170, to LED strip (not shown in FIGS. 16, 16A and 16B), similarly to that described in conjunction with other FIGS., e.g., FIG. 2A. Power adapter 160 is usually placed beneath deck 120 so as to be not visible. As a result, a complete conductive electric circuit is created. FIGS. 16A and 16B show a front view of a section of transmitter (TX) strip 1610 comprising a plurality of TX coils 1590 connected in parallel. TX coils 1590, in the embodiment shown in FIGS. 16A and 16B, are placed about every 4"-10" to meet the power transfer requirements of shelves 130 and LED devices 210. Transmitter (TX) strip 1610 can be provided with an arrangement of a numbers of coils as shown in FIGS. 16A and 16B, as well as can be provided with one coil running substantially from the bottom to the top of transmitter (TX) strip 1610, depending on power transfer requirements, cost and part/chip development, considering both function and cost. There is a small gap between the surface of transmitter (TX) strip 1610 and receiver (RX) box 1630, not direct contact, as will be more fully explained in conjunction with FIGS. 17 and 17A. Transmitter (TX) strip 1610 can be placed on the front surface of pegboard/pegboard support 125 or behind pegboard/pegboard support 125.

Figure 17:
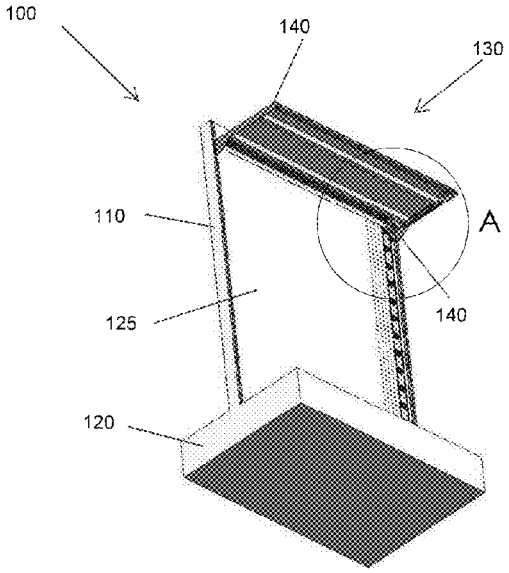
FIG. 17 is a bottom perspective view of the gondola, shelf, and vertical transmitter strip of FIG. 16.
Figure 17A:
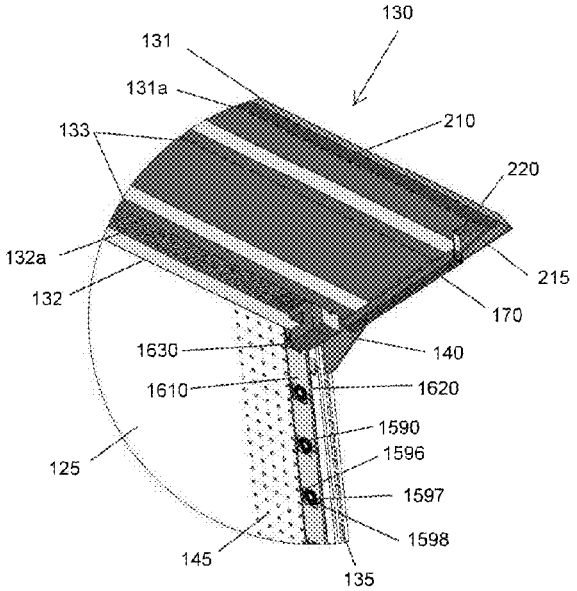
FIG. 17A is an enlarged view of section "A" of FIG. 17.

FIG. 17 is a bottom perspective view of gondola system 100 of FIG. 16 showing the connection of receiver (RX) box 1630 to shelf 130. FIG. 17A is an enlarged view of section "A" of FIG. 17. Shelf 130 has a front edge 131 and a rear edge 132. The underside of shelf 130 also generally includes one or more support bars 133 for supporting weight disposed on the top side of shelf 130. Disposed proximal front edge 131 and rear edge 132 are rows of evenly spaced (along X and Y axes)

holes 131*a* and 132*a*, respectively. Disposed at each end of shelf 130 is shelf bracket 140. FIGS. 17 and 17A show an LED device 210 (such as an LED strip or LED tube) disposed on the bottom side of shelf 130. Placement of LED device 210 on the bottom side of shelf 130 serves to illuminate display merchandise (not shown) on the top side of a lower shelf (not shown). An electrical cord 215 consists of two electrical wires, positive and negative, and conductively connects to receiver (RX) box 1630, passing through wire tube 170, as was described in more detail in conjunction with FIG. 5. As noted, one wire of electrical cord 215 is connected to the positive pole of LED device 210 and the other wire of electrical cord 215 is connected to the negative pole of LED device 210. Wire tube 170 has a front foot 220 and a rear foot 225 (not shown in FIGS. 17 and 17A, but see FIGS. 2A, 3A and 5). Front foot 220 is connected to one or more front holes 131*a* and rear foot 225 is connected to one or more rear holes 132*a*, respectively, using push pins 230 (see, FIGS. 2A and 3A). Electrical cord 215 passes through wire tube 170 from receiver (RX) box 1630 to LED device 210. LED device 210 is affixed to the underside of shelf 130 between front foot 220 (on the right side of shelf 130, as shown) and a matching metal panel similar to front foot 220 on the left side of shelf 130 (not shown) by magnets (not shown) disposed at each end of LED device 210. Receiver (RX) box 1630 is placed in position so as to meet two considerations for the embodiment shown. First, TX coil 1590 and RX coil 1595 should be face-to-face to ensure optimal power transfer between the two. Second, transmitter (TX) 1510 and receiver (RX) 1520 should also be located within the spherical dimension of the inductive coupling field to further ensure optimal power transfer. Transmitter (TX) strip 1610 and receiver (RX) box 1630 are designed and built taking the above two factors into consideration.

Figure 18:
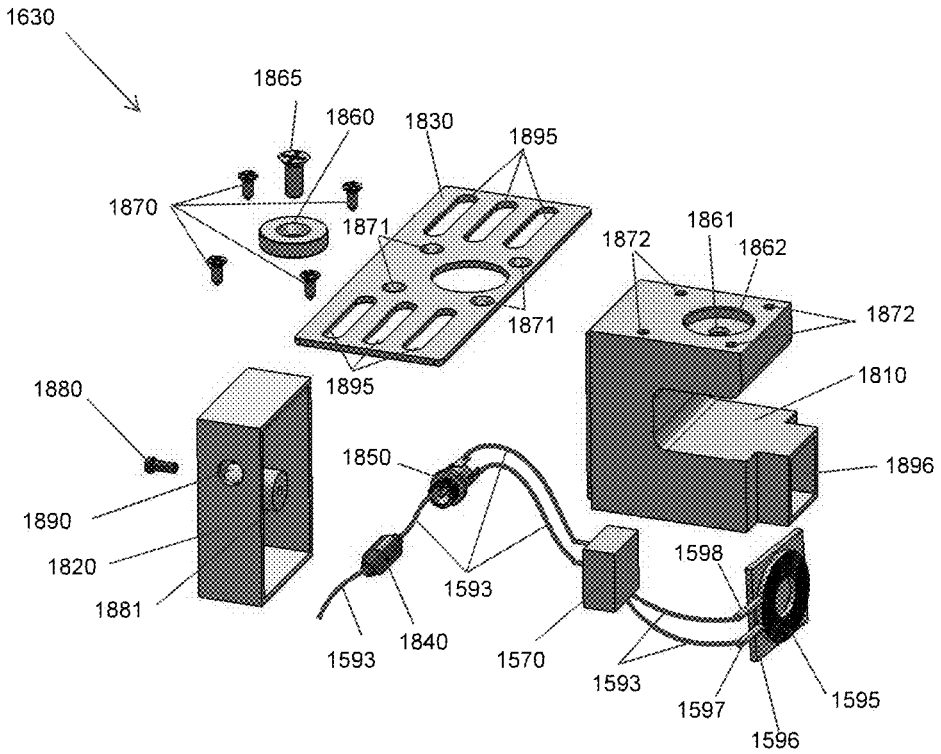
FIG. 18 is an exploded view of a receiver of the wireless power transfer system according to the second alternative embodiment of the present disclosure

FIG. 18 shows an exploded view of receiver (RX) box 1630. Receiver (RX) box 1630 includes a plastic RX holder box 1810, an RX box cap 1820, RX coil 1595 with electric leads 1597, 1598 on base 1596, RX control 1570, base panel 1830, output plug 1840 and output socket 1850, magnet ring 1860 with associated base locking pin 1865 (for locking magnet 1860 into locking hole 1861 associated with magnet positioning cavity 1862) and base screws 1870 for passing through screw holes 1871 of base panel 1830 and fastening into associated screw holes 1872 of receiver (RX) 1630. A cap screw 1880 passes through associated a cap locking pin 1881 for attaching RX box cap 1820 to RX holder box 1810. RX box cap 1820 also has a socket hole 1890 for accepting output plug 1840 and output socket 1850. Finally, base panel 1830 has a series of elliptical slots 1895 so that the position of receiver (RX) box 1630 in association with rear holes 132*a* can be readily adjusted. As shown in FIG. 18, RX control 1570 connecting both RX coil 1595 and socket 1850 and plug 1840 is placed within RX holder box 1810 below cap locking pin 1881 and connects to RX coil 1595 and socket 1850 and plug 1840 by wires 1593. RX coil 1595 is placed on base 1596 that is designed and configured to act as a "cap" to associate with an opening 1896 of RX-holder box 1810. Socket 1850 and plug 1840 are placed in socket hole 1890 on the side wall of RX box cap 1820 to connect wire 1593 (extending from plug 1840) to LED device 210. RX-box cap 1820 affixes into RX-holder box 1810 by cap locking pin 1881 and cap screw 1880. Base panel 1830 is placed on top of RX-holder box 1810 and affixed by base locking pin 1865 and base screws 1870. Magnet ring 1860, preferably a permanent magnet, is placed onto magnet positioning cavity 1862 after passing through locking hole 1861. Receiver (RX) box 1630 is affixed on the bottom of shelf 130 by magnet ring 1860 and further locked by push pins 230 in rear holes 132*a*. Of course, the sizes and shape of receiver RX box 1630 is subject to design considerations and can be changed accordingly.

As mentioned earlier, the transmitter coil can be designed and built in many ways including individual planer, elongate-vertical-strip-size, and others. The transmitter itself can be in a centralized location away from the location of the gondola(s) having the receiver(s) and the transmitter can be provided with a sufficiently large spherical inductive coupling field to control a group of receivers. Thus, one central transmitter can transfer power to a numbers of receivers to illuminate LED devices on a plurality of shelves. For example, the system can be designed so that one central transmitter can power all of the LED devices on the shelves of a 28' gondola.

As will be appreciated, the low-voltage plug and play display system of the present disclosure is applicable for installation for gondola systems in general, including existing gondola walls and/or new gondola walls, pegboard or solid walls, as well as wooden, plastic or metal gondola walls. The low-voltage plug and play display system of the present disclosure may be adapted for gondola wall systems or for free-standing displays, and is suitable for shelving systems in general. In addition, the low voltage plug and play display system of the present disclosure is suitable for either retrofitting existing gondola systems or for installations of new gondola systems.

As can been seen from the discussion of the FIGS., the electricity-bearing elements of the present disclosure only come in electricity-transferring contact with other elements that are intended to carry electricity, and are prevented from contacting other such non-electricity carrying elements through contact with insulated materials, such as plastic clamps, channels, screws and the like.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A power supply for a gondola display system, the power supply comprising:

an elongate strip adapted to be disposed substantially parallel to a row of vertically disposed slots on the gondola surface, wherein the elongate strip comprises:

a front side disposed distal the gondola surface;

a rear side disposed proximal the gondola surface; and two substantially parallel insulated channels, wherein each substantially parallel insulated channel has an elongate conductive strip disposed therein proximal the rear side, and wherein one elongate conductive strip comprises a positive pole and one conductive strip comprises a negative pole; and a shelf connector adapted to be affixed to a bottom side of a shelf having a lighting device between the elongate strip and the lighting device, wherein the shelf connector has an internal volume, wherein the shelf connector has four spring actuated conductive prongs disposed through a wall of the shelf connector, wherein the conductive prongs are configured to conduct current to and from the elongate strip, wherein two of the four conductive prongs are disposed and configured to engage the conductive strip comprising the positive pole, wherein two of the four conductive prongs are disposed and configured to engage the conductive strip comprising the negative pole, wherein the shelf connector has a socket disposed through a wall of the shelf connector at an orientation of approximately 90° from the conductive prongs, wherein the socket is configured to conduct current to and from the lighting device, and wherein, in the internal volume of the shelf connector, the current received from the elongate strip is supplied to the socket.

2. The power supply according to claim 1, wherein the shelf connector further comprises a plug having an electric cord that is disposed and configured to conductively mate with the socket to supply electric current to and receive electric current from the lighting device.

3. The power supply according to claim 1, wherein the conductive strips conductively connect to a low-voltage power source and conduct low-voltage DC.

4. A display system that includes the power supply according to claim 1.

5. A power supply for a gondola display system, the power supply comprising:

a power supply upright adapted to be disposed in an inner volume of a vertical upright disposed at an edge of the gondola display system, wherein the power supply upright has at least one slot disposed therein proximal to and aligning with a row of vertically disposed slots in the upright, wherein the power supply upright has two substantially parallel insulated channels disposed away from the at least one row of vertically disposed slots, wherein each substantially parallel insulated channel has an elongate conductive strip disposed therein, and wherein one elongate conductive strip comprises a positive pole and one conductive strip comprises a negative pole; and a shelf connector adapted to be affixed to a bottom side of a shelf having a lighting device between the elongate strip and the lighting device, wherein the shelf connector has an internal volume, wherein the shelf connector has at least two spring actuated conductive prongs, wherein one of the at least two conductive prongs is disposed and configured to pass into the inner volume of the vertical upright and engage the conductive strip comprising the positive pole, and wherein another of the at least two conductive prongs is disposed and configured to pass into the inner volume of the vertical upright and engage the conductive strip comprising the negative pole.

6. The power supply display system according to claim 5, wherein the shelf connector further comprises a socket disposed and configured to conductively mate with a plug having an electric cord that is disposed and configured to supply electric current to and receive electric current from the lighting device.

7. The power supply according to claim 5, wherein the conductive strips conductively connect to a low-voltage power source and conduct low-voltage DC.

8. A display system that includes the power supply according to claim 5.

9. A power supply for a gondola display system, the power supply comprising:

an elongate strip adapted to be disposed substantially parallel to a row of disposed slots on the gondola surface, wherein the elongate strip has a front side disposed distal the gondola surface, a rear side disposed proximal the gondola surface, and at least one transmitter having a transmitter coil disposed on the front side, and wherein the transmitter is adapted to transmit wireless power; and a shelf connector adapted to be affixed to a bottom side of a shelf having a lighting device between the elongate strip and the lighting device, wherein the shelf connector has at least one receiver having a receiver coil adapted to be disposed in communicative relation to the transmitter coil, wherein the receiver receives the wireless power transmitted by the transmitter coil by inductive coupling, and wherein the receiver converts the transferred wireless power into electric current.

10. The power supply according to claim 9, wherein the shelf connector further comprises a socket disposed and configured to conductively mate with a plug having an electric cord that is disposed and configured to supply the electric current to and receive the electric current from the lighting device.

11. The power supply according to claim 9, wherein the power transferred by inductive coupling between the transmitter and receiver is converted to low-voltage DC.

12. The power supply according to claim 9, wherein the transmitter coil has a shape selected from the group consisting of circular, elongated, planar and any combinations thereof.

13. The power supply according to claim 9, wherein the receiver is disposed at a location selected from the group consisting of between the gondola surface and the lighting device, adjacent to the lighting device, integral with the lighting device and attached to the lighting device.

14. A display system that includes the power supply according to claim 9.

15. A wireless power supply for a lighting device, the wireless power supply comprising:

at least one transmitter comprised of a transmitter control, a transmitter coil and a capacitor-resonance circuit that provides power via inductive coupling, wherein the transmitter control receives electric power and converts the electric power to a wireless power signal, and wherein the transmitter transmits the wireless power signal; and at least one receiver electrically connected to the lighting device, the receiver comprised of a receiver control, a receiver coil and a capacitor-resonance circuit that receives power via inductive coupling, wherein the receiver receives the wireless power signal from the transmitter, and wherein receiver control converts the wireless power signal to electric power and provides the electric power to the lighting device.

16. The wireless power supply according to claim 15, wherein the transmitter is disposed at a centralized location away from the receiver.

17. The wireless power supply according to claim 15, wherein the transmitter has an inductive coupling field sufficient to transfer power to the at least one receiver.

18. The wireless power supply according to claim 15, wherein the receiver is disposed at a location selected from the group consisting of between the gondola surface and the lighting device, adjacent to the lighting device, integral with the lighting device and attached to the lighting device.

19. A display system that includes the wireless power supply according to claim 15.

* * * * *